US008688018B2

(12) United States Patent
Uezono et al.

(10) Patent No.: US 8,688,018 B2
(45) Date of Patent: Apr. 1, 2014

(54) DEVELOPING DEVICE AND IMAGE FORMING APPARATUS INCLUDING THE SAME

(75) Inventors: Tsutomu Uezono, Kanagawa (JP); Takafumi Wakai, Kanagawa (JP); Yasuyuki Tsutsumi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 206 days.

(21) Appl. No.: 13/402,524

(22) Filed: Feb. 22, 2012

(65) Prior Publication Data

US 2013/0051869 A1 Feb. 28, 2013

(30) Foreign Application Priority Data

Aug. 31, 2011 (JP) ..... 2011-189194

(51) Int. Cl.
*G03G 15/08* (2006.01)

(52) U.S. Cl.
USPC ..... 399/285

(58) Field of Classification Search
USPC ..... 399/285
See application file for complete search history.

(56) References Cited

U.S. PATENT DOCUMENTS

| | | | | |
|---|---|---|---|---|
| 5,247,333 | A | 9/1993 | Yamamoto et al. | |
| 6,343,201 | B1 * | 1/2002 | Wada et al. | 399/281 |
| 6,965,743 | B2 * | 11/2005 | Nakagawa et al. | 399/55 |
| 7,013,103 | B2 * | 3/2006 | Bae | 399/283 |
| 2001/0055503 | A1 * | 12/2001 | Kin et al. | 399/284 |
| 2003/0219285 | A1 * | 11/2003 | Nakagawa | 399/281 |
| 2007/0065167 | A1 * | 3/2007 | Yamamura | 399/55 |
| 2011/0188899 | A1 * | 8/2011 | Nishiwaki | 399/285 |

FOREIGN PATENT DOCUMENTS

| | | | |
|---|---|---|---|
| JP | 6-051623 | A | 2/1994 |
| JP | 10-319720 | A | 12/1998 |
| JP | 2007-086447 | A | 4/2007 |
| JP | 2007086447 | A * | 4/2007 |

* cited by examiner

*Primary Examiner* — G. M. Hyder
(74) *Attorney, Agent, or Firm* — Sughrue Mion, PLLC

(57) ABSTRACT

A developing device includes a container, a toner holding member, a developing electric field forming unit, a layer forming unit, an electrode member, and a low-frequency electric field forming unit. The container accommodates toner. The toner holding member holds toner and transports the toner to a developing region where the toner holding member and the latent image holding member face. The developing electric field forming unit forms a developing electric field for developing a latent image held on a latent image holding member. The layer forming unit forms a toner layer on the toner holding member prior to the developing region. The electrode member faces the toner holding member. The low-frequency electric field forming unit forms a low-frequency electric field acting on residual toner between the electrode member and the toner holding member, and forms stripe-shaped projections in accordance with a period of the low-frequency electric field.

11 Claims, 26 Drawing Sheets

FIG. 26

| FREQUENCY (Hz) | 25 | 50 | 75 | 100 | 125 | 150 | 175 |
|---|---|---|---|---|---|---|---|
| WIDTH OF STRIPE-SHAPED PROJECTION (mm) | 6 | 3 | 2 | 1.5 | 1.2 | 1 | 0.8 |
| STRIPE PATTERN (VISUALLY OBSERVED) | GOOD | GOOD | GOOD | GOOD | SLIGHTLY BETTER | SLIGHTLY BETTER | BAD |
| GHOSTING (VISUALLY OBSERVED) | △ | ○ | ○ | ○ | ○ | ○ | ○ |

DEVELOPING DEVICE AND IMAGE FORMING APPARATUS INCLUDING THE SAME

CROSS-REFERENCE TO RELATED APPLICATIONS

This application is based on and claims priority under 35 USC 119 from Japanese Patent Application No. 2011-189194 filed Aug. 31, 2011.

BACKGROUND

(i) Technical Field

The present invention relates to a developing device and an image forming apparatus including the same.

SUMMARY

According to an aspect of the invention, there is provided a developing device including a container, a toner holding member, a developing electric field forming unit, a layer forming unit, an electrode member, and a low-frequency electric field forming unit. The container accommodates toner serving as developer, and has an opening facing a latent image holding member that holds a latent image. The toner holding member is rotatably disposed in the container in such a manner that the toner holding member faces the latent image holding member in a portion thereof facing the opening. The toner holding member is configured to hold toner and transport the toner to a developing region where the toner holding member and the latent image holding member face. The developing electric field forming unit forms a developing electric field for developing the latent image on the latent image holding member using the toner on the toner holding member in the developing region where the toner holding member and the latent image holding member face. The layer forming unit is provided for the toner holding member, and forms a toner layer having a predetermined layer thickness on the toner holding member prior to the developing region. The electrode member is disposed so as to face the toner holding member at a position which is downstream of the developing region and upstream of the layer forming unit in a rotation direction of the toner holding member, and is disposed so as to extend in a direction intersecting the rotation direction of the toner holding member. The electrode member includes at least a portion formed of a conductive member, and is used to make an electric field act between the conductive member and the toner holding member. The low-frequency electric field forming unit forms a low-frequency electric field whose polarity alternately changes periodically at a predetermined low frequency. The low-frequency electric field is made to act on residual toner between the electrode member and the toner holding member. The low-frequency electric field forming unit causes the residual toner on the toner holding member to move to form stripe-shaped projections having a visually observable size in the rotation direction of the toner holding member in accordance with a period of the low-frequency electric field.

BRIEF DESCRIPTION OF THE DRAWINGS

Exemplary embodiment(s) of the present invention will be described in detail based on the following figures, wherein:

FIGS. 3A to 3D illustrate the effect of scraping off residual toner using a toner supply member, in which FIGS. 3A and 3B illustrate an example in which stripe-shaped projections are formed and FIGS. 3C and 3D illustrate an example in which stripe-shaped projections are not formed;

FIG. 26 is a table illustrating a result of an example.

DETAILED DESCRIPTION

Overview of Exemplary Embodiment

Figure 1A:
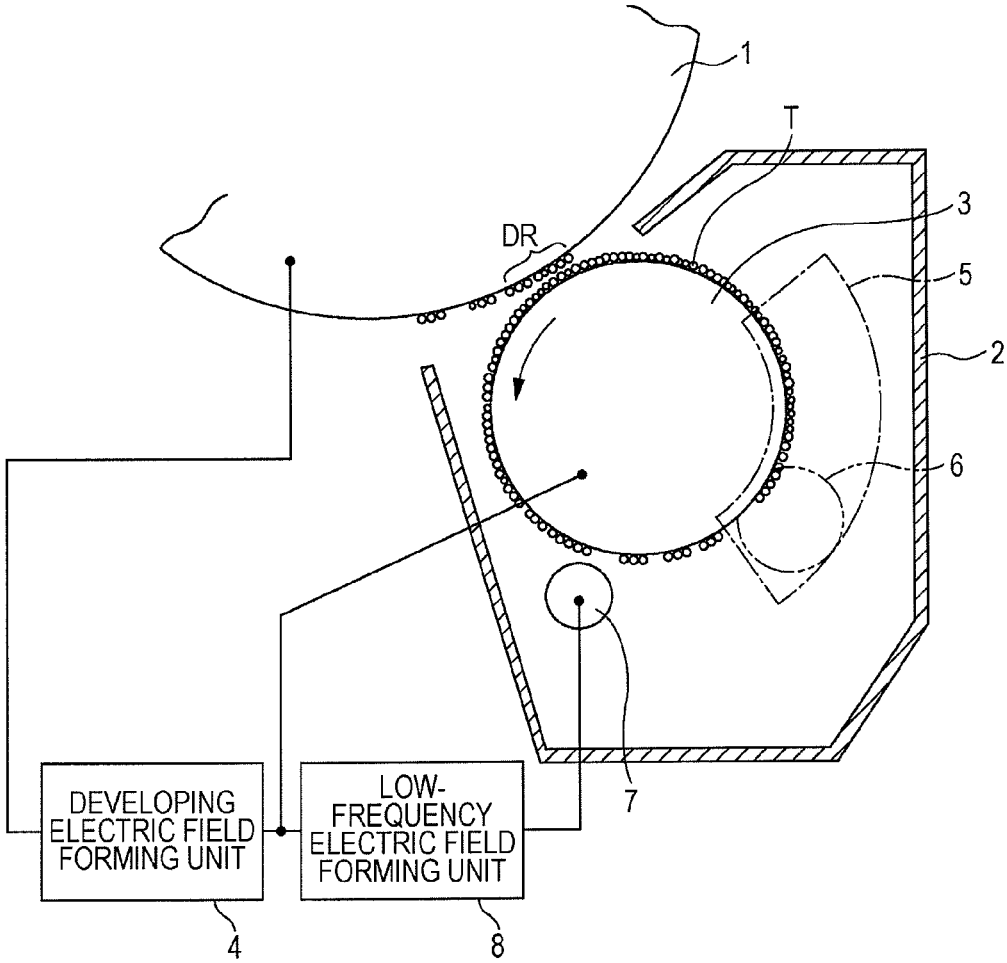
FIG. 1A illustrates an overall configuration of a developing device according to an exemplary embodiment of the present invention.

First, an overview of a developing device according to an exemplary embodiment of the present invention will be described with reference to FIGS. 1A and 1B. FIG. 1A illustrates an overall configuration of the developing device according to the exemplary embodiment of the present invention, and FIG. 1B is an enlarged view of part of the developing device illustrated in FIG. 1A.

Figure 1B:
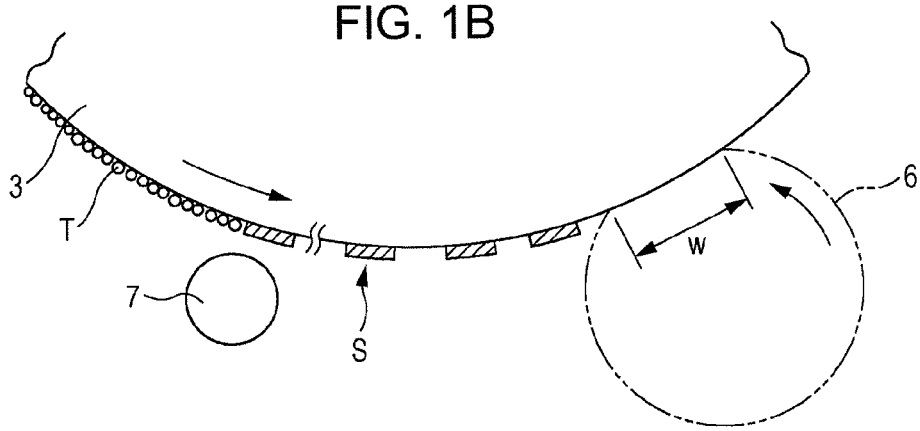
FIG. 1B is an enlarged view of a portion of the developing device illustrated in FIG. 1A.

In FIGS. 1A and 1B, the developing device includes a container 2, a toner holding member 3, a developing electric field forming unit 4, a layer forming unit 5, an electrode member 7, and a low-frequency electric field forming unit 8. The container 2 has an opening facing a latent image holding member 1 that holds a latent image, and accommodates toner T serving as developer. The toner holding member 3 is rotatably disposed in the container 2 in such a manner that the toner holding member 3 faces the latent image holding member 1 in a portion thereof facing the opening, and is configured to hold the toner T and transport the toner T to a developing region DR where the toner holding member 3 faces the latent image holding member 1. The developing electric field forming unit 4 forms a developing electric field for developing the latent image on the latent image holding member 1 by causing the toner T on the toner holding member 3 to fly to the developing region DR where the latent image holding member 1 faces the toner holding member 3. The layer forming unit 5 is provided for the toner holding member 3, and is configured to form a toner layer having a predetermined layer thickness on the toner holding member 3 prior to the developing region DR. The electrode member 7 is disposed so as to face the toner holding member 3 at a position that is downstream of the developing region DR and upstream of the layer forming unit 5 in the rotation direction of the toner holding member 3, and is also disposed so as to extend in a direction intersecting the rotation direction of the toner holding member 3. The electrode member 7 includes at least a portion formed of a conductive member, and is used to make an electric field act between the conductive member and the toner holding member 3. The low-frequency electric field forming unit 8 forms a low-frequency electric field whose polarity alternately changes periodically at a predetermined low frequency, and the low-frequency electric field is made to act on residual toner T between the electrode member 7 and the toner holding member 3. The low-frequency electric field forming unit 8 further moves the residual toner T on the toner holding member 3 to form stripe-shaped projections S having a visually observable size in the rotation direction of the toner holding member 3 in accordance with the period of the low-frequency electric field.

The toner holding member 3 may be a roller-shape or belt-shaped member. The developing electric field formed by the developing electric field forming unit 4 may have only a direct current (dc) component or an alternating current (ac) component superimposed on a dc component. The toner holding member 3 and the latent image holding member 1 may come into contact with each other through the toner T in the developing region DR.

The layer forming unit 5 is configured to form on the toner holding member 3 a toner layer which moves towards the developing region DR, and may be any device configured to form a toner layer having a predetermined thickness on the toner holding member 3. For example, the layer forming unit 5 may include a toner supply member 6 that supplies the toner T to the toner holding member 3, and a layer thickness regulating member that is disposed downstream of the toner supply member 6 and that regulates the thickness of the toner layer on the toner holding member 3. Alternatively, the layer forming unit 5 may include, for example, a member having a depression that is disposed in close proximity to the toner holding member 3 to supply the toner T, and a layer thickness regulating member that is disposed downstream of the member and that regulates the thickness of the toner layer on the toner holding member 3. The layer forming unit 5 allows at least a portion of the stripe-shaped projections S to be scraped off from the toner holding member 3.

The electrode member 7 may be disposed in close proximity to or in contact with the toner holding member 3. When the electrode member 7 is disposed in close proximity to the toner holding member 3, the electrode member 7 may be implemented as, for example, a member having a desired shape, such as a roller-shaped or plate-shaped member. When the electrode member 7 is disposed so as to be in contact with the toner holding member 3, the electrode member 7 may be implemented as a member that is elastically deformable so as to allow the toner T to pass, such as a sheet-shaped member. The electrode member 7 may also be provided so as to extend in a direction intersecting the rotation direction of the toner holding member 3. In order to reduce the space for installation or simplification of structure, the electrode member 7 may be provided so as to extend in a width direction perpendicular to the rotation direction of the toner holding member 3 among the directions intersecting the rotation direction of the toner holding member 3. It is desirable that the electrode member 7 have a smaller surface roughness. Thus, the toner T may be less fixed to the surface of the electrode member 7, and the toner T, which has been attracted toward the electrode member 7, may be readily attracted toward the toner holding member 3.

The low-frequency electric field forming unit 8 is configured to create a low-frequency electric field for forming the stripe-shaped projections S when the residual toner T passes through the electrode member 7, and an electric field is caused to appear as a wave whose polarity alternately changes periodically, such as a rectangular wave or a sine wave, between the toner holding member 3 and the electrode member 7. When an electric field is caused to appear as a rectangular wave, the intervals between the stripe-shaped projections S may be made different by changing the duty ratio of the rectangular wave. For example, when the developing electric field includes a high-frequency component, the low-frequency electric field forming unit 8 may apply a high-frequency component having a frequency close to the frequency of the high-frequency component to the electrode member 7 to make an equivalent beat component act between the electrode member 7 and the toner holding member 3 due to the difference between the frequencies. The beat component may be a low-frequency electric field.

The term "stripe-shaped projections S", as used herein, refers to, as illustrated in FIG. 1B, projections S for which a thin toner layer portion between adjacent projections S is equal to one period. The projections S may not necessarily have a rectangular cross section, and may be formed so as to project from the surface of the toner holding member 3. The stripe-shaped projections S are visually observable and each projection S may generally have a width of substantially 0.5 mm or more.

In order to easily change the stripe-shaped projections S, it is preferable that the low-frequency electric field forming unit 8 satisfy a relationship of $f \leq v/d$ when forming a low-frequency electric field, where v denotes the peripheral speed (mm/second) of the toner holding member 3, f denotes the frequency (Hz) of the low-frequency electric field, and d denotes the minimum dimension (mm) of the period of the stripe-shaped projections S. Therefore, a stripe pattern with a period greater than or equal to d (mm) (a pattern in which the projections S are arranged with certain intervals) may be formed.

The process of forming the stripe-shaped projections S will now be described with reference to FIGS. 2A to 2D. Here, a region in which a low-frequency electric field is made to act between the electrode member 7 and the toner holding member 3 is referred to as an "acting area x". In addition, the peripheral speed of the toner holding member 3 is represented by v, a direction in which an electric field component that attracts the toner T toward the electrode member 7 within the low-frequency electric field acting on the acting area x is represented by an arrow E1, and a direction in which an electric field component that attracts the toner T toward the toner holding member 3 is represented by an arrow E2. In the following description, furthermore, it is assumed that the gap between the electrode member 7 and the toner holding member 3 is sufficiently larger than the predetermined thickness (which represents the layer thickness of new toner T which has been transported to the holding member 3 in FIGS. 2A to 2D) of the toner layer formed on the toner holding member 3 by the layer forming unit 5. Here, negatively charged toner is used as the toner T, by way of example, and it is to be noted that the toner T is attracted in the direction opposite to the directions of the electric field components E1 and E2.

Figure 2A:
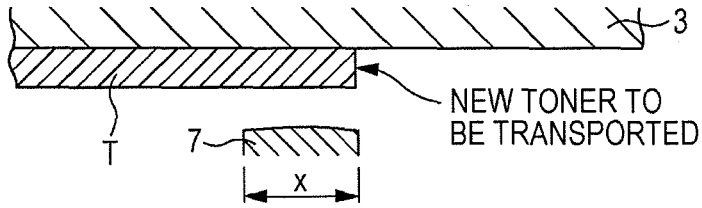
FIGS. 2A to 2D schematically illustrate the process of forming stripe-shaped projections by using a low-frequency electric field.

In FIGS. 2A to 2D, it is assumed first that the toner T exists between the electrode member 7 and the toner holding member 3 in a manner as illustrated in FIG. 2A. The toner T corresponds to new toner that is transported in accordance with the rotation of the toner holding member 3.

Figure 2B:
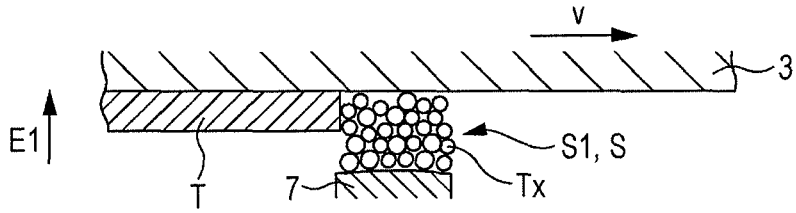

In the above state, as illustrated in FIG. 2B, the electric field component E1 that attracts the toner T toward the electrode member 7 is made to act as a low-frequency electric field. In addition, when the toner holding member 3 is rotated, the toner T is attracted toward the electrode member 7, resulting in the toner T building up in the acting area x, which is called toner clogging (in FIG. 2B, a portion Tx where toner is densely deposited). The toner clogging forms a first projection S1 described below.

Figure 2C:
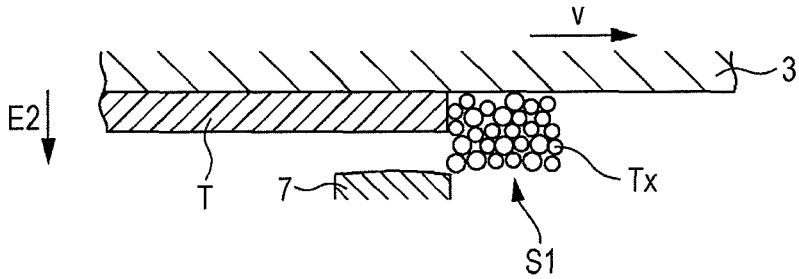

Then, when the low-frequency electric field is switched to the electric field component E2 that attracts the toner T toward the toner holding member 3, as illustrated in FIG. 2C, the toner clogging in the acting area x illustrated in FIG. 2B is transported to the downstream side and the first projection S1 is formed on the toner holding member 3 downstream of the electrode member 7. At this time, new toner T has been transported to the toner holding member 3 from which the toner clogging has been removed, and the toner T is supplied to the acting area x of the electrode member 7.

Figure 2D:
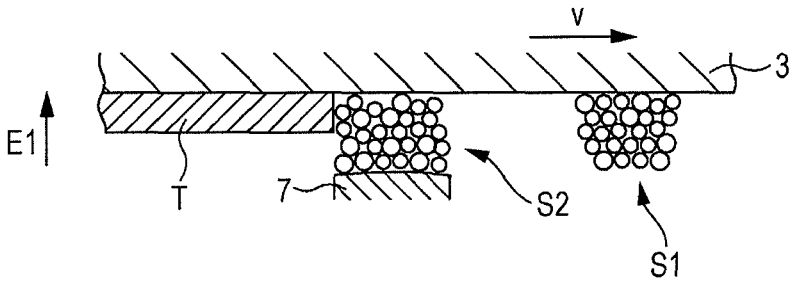

Then, when the low-frequency electric field is switched again to the electric field component E1 that attracts the toner T toward the electrode member 7, as illustrated in FIG. 2D, the first projection S1 is transported to the downstream side as it is, and new toner clogging occurs in the acting area x. The toner clogging forms a second projection S2.

The repetition of the above effect allows the stripe-shaped projections S to be formed on the toner holding member 3 downstream of the electrode member 7.

Figure 3A:
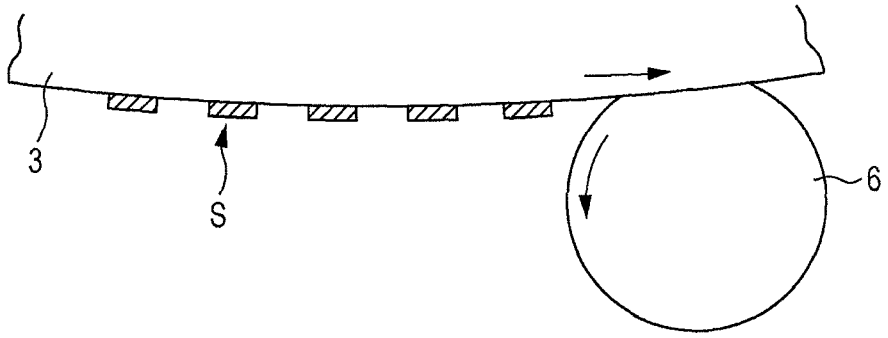
Figure 3B:
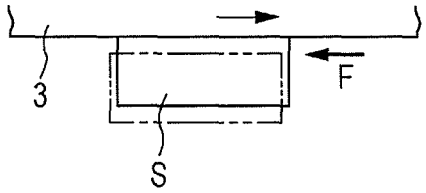

The stripe-shaped projections S are formed on the toner holding member 3 from the residual toner T in the above manner, thereby improving the removal performance of the toner T from the toner holding member 3. The improvement of the removal performance will be described using an example in which the layer forming unit 5 includes the toner supply member 6 that comes into contact with the toner holding member 3. The effect of scraping off the toner T in a portion where the toner holding member 3 and the toner supply member 6 comes into contact with each other when the stripe-shaped projections S are formed on the toner holding member 3 may be as follows: FIGS. 3A and 3B illustrate the effect of scraping off the stripe-shaped projections S on the toner holding member 3 using the toner supply member 6. FIG. 3A illustrates a configuration for scraping off the projections S, and FIG. 3B illustrates the scraping effect.

Since the stripe-shaped projections S are formed on the toner holding member 3, the toner supply member 6 comes into contact with a portion to which a smaller amount of toner T is attached before the projections S have reached the portion where the toner holding member 3 comes into contact with the toner supply member 6. Thus, a force F (corresponding to the scraping force) with which the toner supply member 6 pushes a projection S substantially from the surface of the toner holding member 3 is made to act on the next projection S, and a shear force is applied to the projection S to allow the projection S to be easily scraped off from the toner holding member 3. In addition, since the projections S reach with intervals between the toner holding member 3 and the toner supply member 6, the toner supply member 6 also vibrates in its radial direction. This may easily ensure the cleanliness of the surface of the toner supply member 6.

Figure 3C:
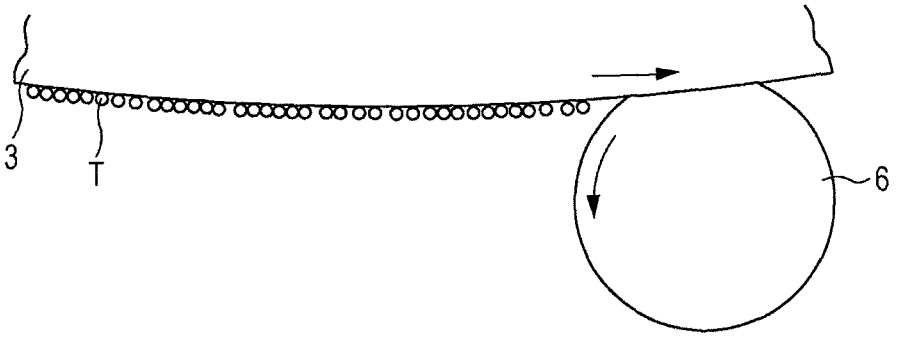
Figure 3D:
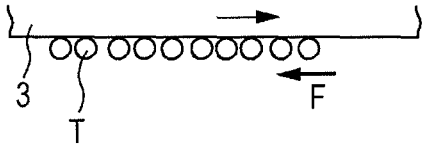

In contrast, FIGS. 3C and 3D illustrate a comparative example in which no low-frequency electric field acts between the electrode member 7 (not illustrated) and the toner holding member 3. FIG. 3C illustrates a configuration for scraping off toner, and FIG. 3D illustrates the scraping effect. Unlike FIGS. 3A and 3B, since the toner T does not form stripe-shaped projections S, a portion to which a smaller amount of toner T is attached is not substantially formed, resulting in the toner T being likely to enter between the toner supply member 6 and the toner holding member 3. Thus, the force F with which the toner supply member 6 scrapes off the toner T may slide over the surface of the toner T, and may not provide sufficient scraping performance. In addition, since the toner T does not form stripe-shaped projections S, the toner supply member 6 will not vibrate in its radial direction.

Thus, the cleanliness of the surface of the toner supply member 6 may be lower than that obtained when the toner supply member 6 vibrates. Therefore, it may be effective to make a low-frequency electric field act on the residual toner T on the toner holding member 3 after the toner holding member 3 has passed through the developing region DR.

When the layer forming unit 5 includes the toner supply member 6 described above, the toner supply member 6 may be in contact with or separate from the toner holding member 3 as long as the toner supply member 6 is capable of supplying toner to the toner holding member 3. The toner supply member 6 supplies the toner T to the toner holding member 3, thereby achieving the effect of scraping off at least part of the residual toner T on the toner holding member 3 from the toner holding member 3. The toner supply member 6 may be configured to supply the toner T directly to the toner holding member 3 or indirectly supply the toner T to the toner holding member 3. For example, the toner supply member 6 may be configured to supply toner T in two-component developer to the toner holding member 3. Additionally, the toner supply member 6 may be configured to supply the toner T between the toner supply member 6 and the toner holding member 3. A scraping member for scraping off the residual toner T on the toner holding member 3 may be provided upstream of the toner supply member 6. In this case, the toner supply member 6 may not necessarily have the effect of scraping off the toner T.

In FIGS. 1A and 1B, in order to effectively make a low-frequency electric field act between the electrode member 7 and the toner holding member 3, preferably, the electrode member 7 is a roller-shaped member disposed so as to face the toner holding member 3 with a gap therebetween exceeding the thickness of the toner layer formed on the toner holding member 3 by the layer forming unit 5. This may make it easier to allow a region in which a low-frequency electric field acts to concentrate between the toner holding member 3 and the electrode member 7, and may therefore make it easier to allow the action of the low-frequency electric field to concentrate.

Furthermore, in order to reduce the adhesion of the toner T in the stripe-shaped projections S to the toner holding member 3, preferably, a relationship of $m \geq n$ is satisfied, where m denotes the width (mm) of an acting area on the electrode member 7 where the low-frequency electric field acts in the rotation direction of the toner holding member 3, and n denotes the moving distance (mm) of the toner holding member 3 in its rotation direction, which corresponds to the time during which an electric field component that attracts the residual toner T on the toner holding member 3 toward the toner holding member 3 within the low-frequency electric field acts. Therefore, if the width m of the acting area is greater than or equal to the moving distance n, an electric field component that attracts the residual toner T on the toner holding member 3 toward the electrode member 7 is made to act on the residual toner T, and the adhesion of the toner T to the toner holding member 3 may be reduced when the stripe-shaped projections S are formed. If the width m of the acting area is shorter than the moving distance n, a portion on which an electric field component that attracts the residual toner T toward the electrode member 7 does not act may be formed when the stripe-shaped projections S are formed, and the adhesion of the toner T to the toner holding member 3 in this portion may not be reduced. This effect will be described below.

In order to easily form the stripe-shaped projections S from the residual toner T, the low-frequency electric field forming unit 8 preferably satisfies a relationship of $E1 \geq E2$ when forming a low-frequency electric field, where E1 denotes an electric field component that attracts the toner T toward the electrode member 7 from the toner holding member 3, and E2 denotes an electric field component that attracts the toner T toward the toner holding member 3 from the electrode member 7. Typically, $E1=E2$, and the low-frequency electric field is implemented only by using an ac component. If $E1>E2$, the residual toner T may be easily attracted toward the electrode member 7 even if a charge amount distribution of the residual toner T becomes wide.

In order to easily form the stripe-shaped projections S described above from the residual toner T, furthermore, the low-frequency electric field forming unit 8 preferably satisfies a relationship of $t1 \geq t2$ when forming a low-frequency electric field, where t1 denotes the acting time of an electric field component that attracts the toner T toward the electrode member 7 from the toner holding member 3 within a period of the low-frequency electric field, and t2 denotes the acting time of an electric field component that attracts the toner T toward the toner holding member 3 from the electrode member 7 within the period of the low-frequency electric field. Typically, $t1=t2$, and such a rectangular wave having a duty ratio of 50% may be easily formed. A sine wave may also be easily applied. For example, if $t1>t2$, the proportion of a projection S in one period of a stripe pattern may be reduced, and a projection S that is narrow and high may be formed even if, for example, the amount of residual toner T is small.

In addition, in order to easily form a low-frequency electric field, when the developing electric field forming unit 4 is configured to form a developing electric field including a high-frequency electric field whose polarity alternately changes periodically at a predetermined high frequency, preferably, the low-frequency electric field forming unit 8 makes a high-frequency electric field having a frequency close to that of the high-frequency electric field in the developing electric field act on the electrode member 7, and uses as a low-frequency electric field a low-frequency beat component produced by the difference between the high-frequency electric fields. In general, when a high-frequency component having a certain frequency and a high-frequency component having a frequency close to the frequency are made to act, a beat having a frequency equal to the difference between the frequencies occurs. Since it may be difficult to generate a low-frequency component between high-frequency components, a low-frequency electric field may be easily formed by using the beat component.

In order to improve the removal performance of the residual toner T, preferably, an electric field acting region on the electrode member 7 is longer than the effective width in the longitudinal direction of the developing region DR. Therefore, the removal performance of the residual toner T with respect to the developing region DR may be improved, and stable development in the developing region DR may be obtained during the developing operation.

In order to form the stripe-shaped projections S in accordance with the amount of residual toner, preferably, a gap changing mechanism that movably supports the electrode member 7 and that changes the gap between the electrode member 7 and the toner holding member 3 is further provided. For example, the gap changing mechanism may move the electrode member 7 by different amounts when the toner T on the toner holding member 3 is not consumed in the developing region DR because of a jam or the like and when the toner T on the toner holding member 3 is consumed in the normal developing operation. The gap changing mechanism may be applied when toner is consumed in different amounts for, for example, a photographic image and a text image, thus allowing the stripe-shaped projections S to be easily formed after the toner holding member 3 has passed through the electrode member 7.

When the layer forming unit 5 includes the toner supply member 6 that supplies the toner T to the toner holding member 3 in contact with the toner holding member 3 when forming the stripe-shaped projections S described above, in order to improve the removal performance of the toner T, as illustrated in FIG. 1B, the toner supply member 6 is rotated in the direction opposite to the rotation direction of the toner holding member 3 in a portion where the toner supply member 6 and the toner holding member 3 are in contact with each other. Preferably, a relationship of w>n is satisfied, where w denotes the contact width (mm) that is the width of the toner holding member 3 in contact with the toner supply member 6 in the rotation direction of the toner holding member 3, and n denotes the moving distance (mm) of the toner holding member 3 which is in its rotation direction, which corresponds to the time during which an electric field component that attracts the residual toner T on the toner holding member 3 toward the toner holding member 3 within the low-frequency electric field acts. Since the surface of the toner supply member 6 is on a portion to which a smaller amount of toner T is attached, the toner T on the toner supply member 6 is moved to the toner holding member 3. Therefore, substantially no toner T is attached or, if any, a small amount of toner T is attached to the surface of the toner supply member 6. A subsequent projection S may be scraped off completely from the surface of the toner supply member 6 to which substantially no toner T is attached. In this case, the length of time during which an electric field component that attracts the residual toner T on the toner holding member 3 toward the toner holding member 3 acts is preferably a half period or less.

In addition, a member that is disposed so as to be in contact with or in close proximity to the toner holding member 3 may be disposed upstream of the electrode member 7, and a charge removal electric field for removing charge from the toner T on the toner holding member 3 may be made to act between the member and the toner holding member 3. In this case, for example, an electric field may be made to act as a charge removal electric field in a direction in which the charges on the residual toner T is canceled.

The above developing device may be used in an image forming apparatus including a latent image holding member 1 that holds a latent image and a developing device that develops the latent image on the latent image holding member 1 using toner T. In this case, the developing device may be implemented as the above developing device.

Exemplary embodiments of the present invention will be described in further detail with reference to the drawings.

First Exemplary Embodiment

Figure 4:
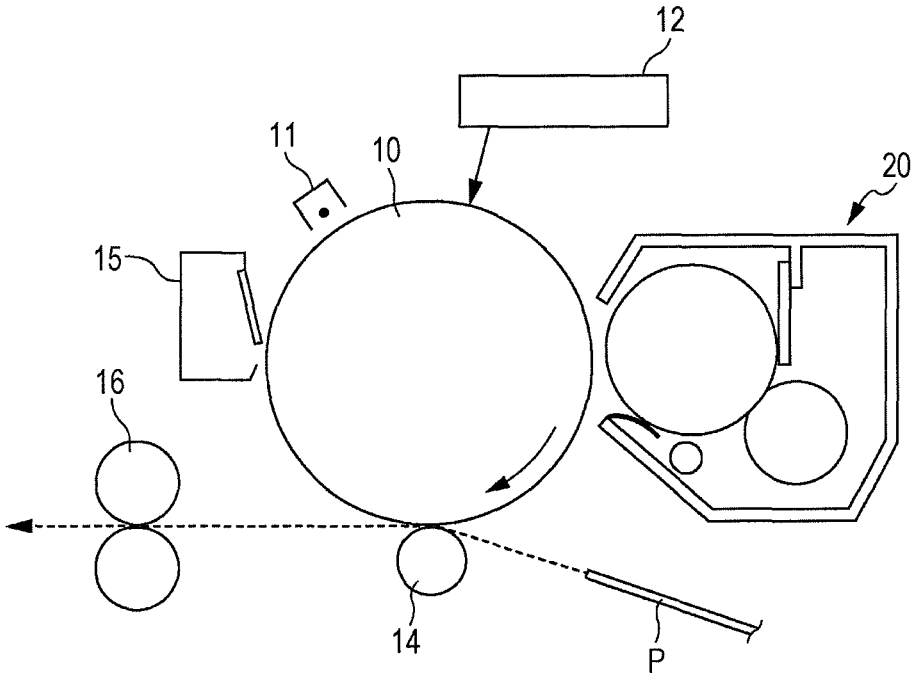
FIG. 4 illustrates an overview of an image forming apparatus according to a first exemplary embodiment.

FIG. 4 illustrates an overview of an image forming apparatus according to a first exemplary embodiment which includes the developing device described above, by way of example.

The image forming apparatus according to this exemplary embodiment includes a photoconductor 10 serving as a latent image holding member, and devices around the photoconductor 10, including a charging device 11, an exposure device 12, a developing device 20, a transfer device 14, and a cleaning device 15. The charging device 11 charges the surface of the photoconductor 10 to a predetermined potential. The exposure device 12 exposes the photoconductor 10 whose surface has been charged by the charging device 11 to form a latent image. The developing device 20 develops the latent image formed by exposure using toner. The transfer device 14 transfers a developed toner image on the photoconductor 10 onto a recording material P supplied from a recording material supply unit (not illustrated). The cleaning device 15 cleans the residual toner on the photoconductor 10 after the transfer operation is performed. The toner image transferred onto the recording material P by the transfer device 14 is fixed onto the recording material P by a fixing device 16, and the recording material P onto which the toner image has been fixed is discharged to a discharge unit (not illustrated).

Figure 5:
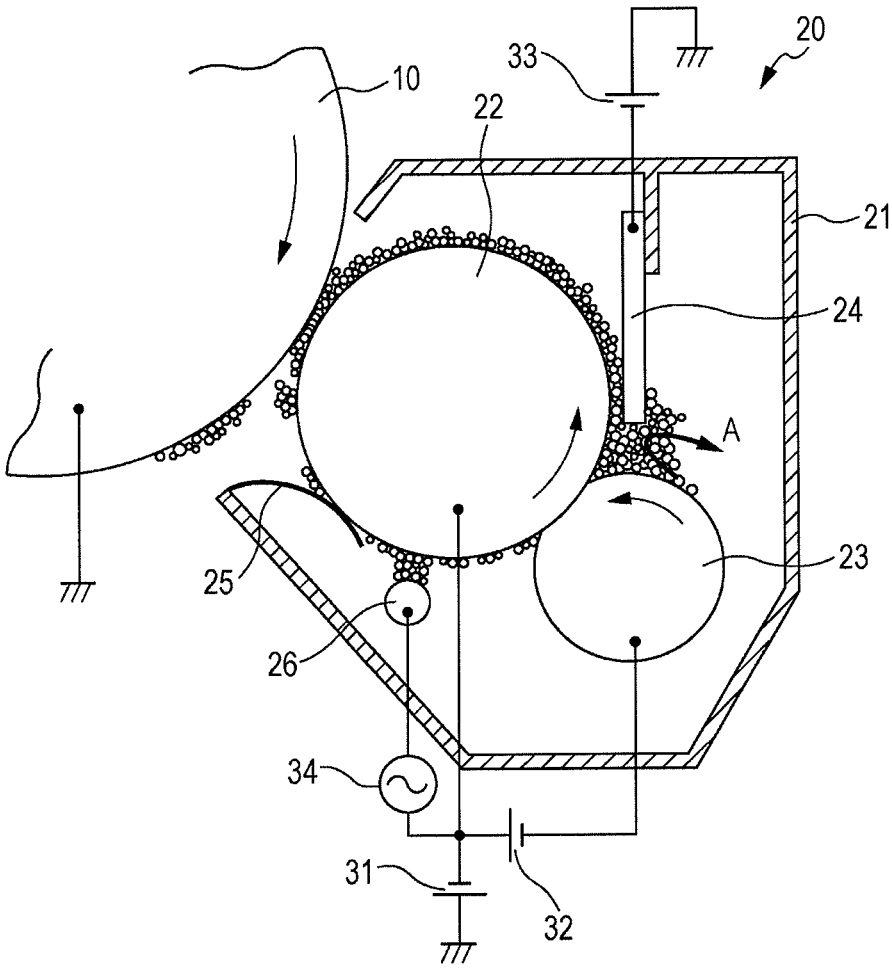
FIG. 5 illustrates an overview of a developing device according to the first exemplary embodiment.

The developing device 20 in the image forming apparatus has a configuration illustrated in FIG. 5. The developing device 20 includes a container 21 that accommodates toner serving as developer, and a developing roller 22 serving as a toner holding member. The container 21 has an opening that opens toward the photoconductor 10. The developing roller 22 is rotatably disposed in the container 21 in such a manner that the developing roller 22 faces the photoconductor 10 in a portion thereof facing the opening of the container 21, and is configured to hold toner and transport the toner to a developing region where the developing roller 22 faces the photoconductor 10. The developing device 20 according to this exemplary embodiment further includes a supply roller 23 serving as a layer forming unit, and a layer thickness regulating member 24. The supply roller 23 is provided so as to face the developing roller 22 at a position upstream of the developing region in the rotation direction of the developing roller 22, and is configured to supply toner to the developing roller 22. The layer thickness regulating member 24 is provided so as to face the developing roller 22 at a position downstream of the supply roller 23 in the rotation direction of the developing roller 22, and is configured to regulate the thickness of a toner layer on the developing roller 22 prior to the developing region. The developing device 20 further includes an electrode member 26 and a sheet-shaped sealing member 25. The electrode member 26 is disposed in close proximity of the developing roller 22 at a position that is downstream of the developing region and upstream of the supply roller 23 in the rotation direction of the developing roller 22. The sealing member 25 is configured to prevent toner from leaking outside the container 21. One end of the sealing member 25 is fixed to the container 21 upstream of the electrode member 26, and a portion near the other end of the sealing member 25 is in contact with the developing roller 22.

The developing roller 22 according to this exemplary embodiment has a peripheral surface which may be formed of, for example, an elastic rubber material whose volume resistance value has been adjusted by a conductive filler such as carbon black. However, the present invention is not limited to this example, and any member whose volume resistance value has been adjusted and which has a peripheral surface on which toner is held and transported, for example, a metal material, may be used.

The supply roller 23 is rotated in a direction different from the rotation direction of the developing roller 22 in a portion where the supply roller 23 and the developing roller 22 are in contact with each other, and may be, for example, a foam roller formed of a foam material whose volume resistance value has been adjusted. However, the present invention is not limited to this example, and a roller member having irregularities on a surface thereof may be used. In this exemplary embodiment, the supply roller 23 is configured to supply toner to the developing roller 22 and also to scrape off the residual toner on the developing roller 22.

The layer thickness regulating member 24 according to this exemplary embodiment is configured such that the downstream end of the layer thickness regulating member 24 in the rotation direction of the developing roller 22 is fixed to the container 21 and the other end serves as a free end extending in a direction opposite to the rotation direction of the developing roller 22. In this example, the layer thickness regulating member 24 extends towards the supply roller 23. The layer thickness regulating member 24 is configured such that, for example, a charging electric field described below is applied to a metal leaf spring formed of a stainless alloy or phosphor bronze alloy. The layer thickness regulating member 24 regulates the layer thickness of the toner on the developing roller 22 supplied by the supply roller 23, and charges the toner on the developing roller 22 by a predetermined charge amount.

Figure 6A:
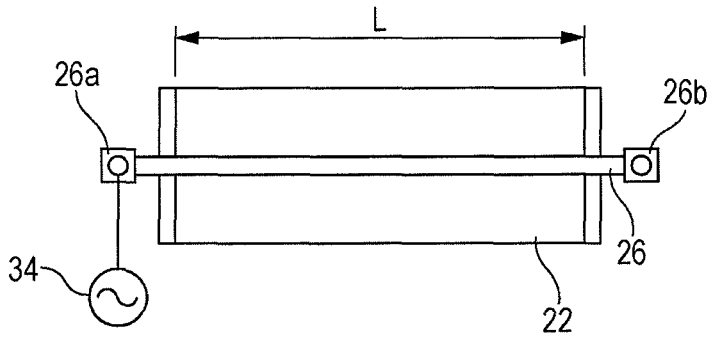
FIG. 6A illustrates a structure in which an electrode member is installed according to the first exemplary embodiment.

As illustrated in FIG. 6A, the electrode member 26 according to this exemplary embodiment is formed of a roller-shaped member which is fixedly disposed with a gap of, for example, 100 to 400 μm with respect to the developing roller 22, and extends to a length more than the effective width L of the developing region of the developing roller 22. The electrode member 26 is further fixed to the container 21 at both ends 26*a* and 26*b* thereof. A low-frequency power source 34 described below is connected to the end 26*a* of the electrode member 26. Further, the electrode member 26 according to this exemplary embodiment is finished so that the surface of the electrode member 26 has an arithmetic average roughness Ra of 5 μm or less. The sealing member 25 may be formed of a polyester sheet having a thickness of, for example, 50 to 100 μm.

Various power sources are connected to the developing device 20 according to this exemplary embodiment in the following manner.

As illustrated in FIG. 5, a developing electric field forming unit is provided for forming a developing electric field for developing a latent image on the photoconductor 10 using the toner on the developing roller 22 in a developing region in a portion where the photoconductor 10 and the developing roller 22 face. In the developing electric field forming unit according to this exemplary embodiment, the photoconductor 10 is connected to a ground and a development power source 31 for applying a developing electric field is connected to the developing roller 22. In addition, a supply power source 32 that applies a supply electric field for supplying the toner on the supply roller 23 to the developing roller 22 is connected between the developing roller 22 and the supply roller 23. In addition, a charging power source 33 that applies a charging electric field for applying a predetermined amount of charge to the toner layer whose thickness has been regulated on the developing roller 22 is connected to the layer thickness regulating member 24.

In this exemplary embodiment, a low-frequency power source 34 serving as a low-frequency electric field forming unit is connected. The low-frequency power source 34 acts on the residual toner between the electrode member 26 and the developing roller 22 to form a low-frequency electric field whose polarity alternately changes periodically at a predetermined low frequency, and moves the residual toner on the developing roller 22 to form stripe-shaped projections having a visually observable size in the rotation direction of the developing roller 22 in accordance with the period of the low-frequency electric field.

Figure 6B:
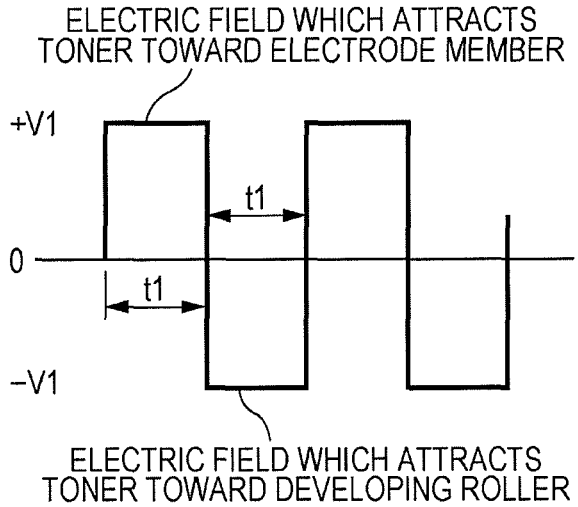
FIG. 6B illustrates a waveform of a low-frequency electric field according to the first exemplary embodiment.

As illustrated in FIG. 6B, a low-frequency rectangular wave inverted during a time period t1, which is a half period, between a +V1 potential and a −V1 potential may be used as the low-frequency power source 34 according to this exemplary embodiment. Therefore, when negatively charged toner is used, an electric field (+V1 potential side) that attracts toner toward the electrode member 26, and an electric field (−V1 potential side) that attracts toner toward the developing roller 22 alternately change periodically with respect to the residual toner on the developing roller 22 after the developing operation is performed. Here, it is assumed that toner is frictionally charged to a negative polarity.

The effect of the developing device 20 having the above configuration will be described.

As illustrated in FIG. 5, the toner in the container 21 is transported to the portion where the supply roller 23 and the developing roller 22 are in contact with each other in accordance with the rotation of the supply roller 23 while the toner is held on the peripheral surface of the supply roller 23. In the portion where the supply roller 23 and the developing roller 22 are in contact with each other, the supply roller 23 and the developing roller 22 are rotated in opposite directions, and the toner to be supplied is attached onto the developing roller 22.

The toner that has moved to the developing roller 22 is processed by the layer thickness regulating member 24 so that the layer thickness of the toner on the developing roller 22 is regulated, and is transported as a toner layer having a predetermined thickness to the developing region along the developing roller 22. In this case, a predetermined amount of charge is applied to the toner using a charging electric field formed by the layer thickness regulating member 24. In FIG. 5, an arrow A indicates the flow of toner whose layer thickness has been regulated by the layer thickness regulating member 24.

The toner layer whose thickness has been regulated on the developing roller 22 reaches the developing region as it is, and a large amount of toner is consumed in a portion corresponding to an image portion on the photoconductor 10. A small amount of toner remains on the developing roller 22 or the toner on the developing roller 22 is completely consumed, and the surface of the developing roller 22 is exposed. In a non-image portion, in contrast, substantially no toner is consumed, and a large amount of toner remains on the developing roller 22. As a result, the developing roller 22 obtained after the developing operation is performed has a portion where toner has been consumed in the developing operation and a portion where substantially no toner has been consumed. The toner on the developing roller 22 is moved to the sealing member 25 disposed downstream of the developing roller 22. The residual toner on the developing roller 22 reaches a portion where the developing roller 22 and the electrode member 26 face through the sealing member 25.

Figure 7A:
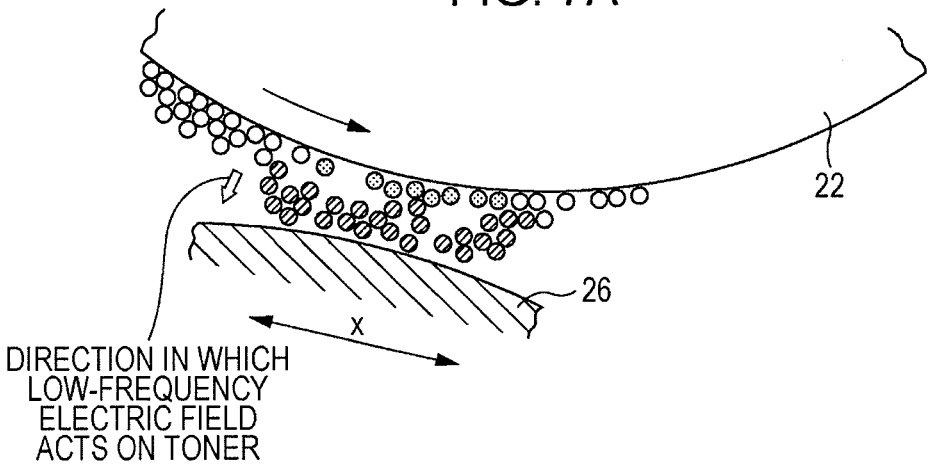
FIGS. 7A to 7C illustrate a process for forming stripe-shaped projections by using a low-frequency electric field according to this exemplary embodiment.
Figure 7B:
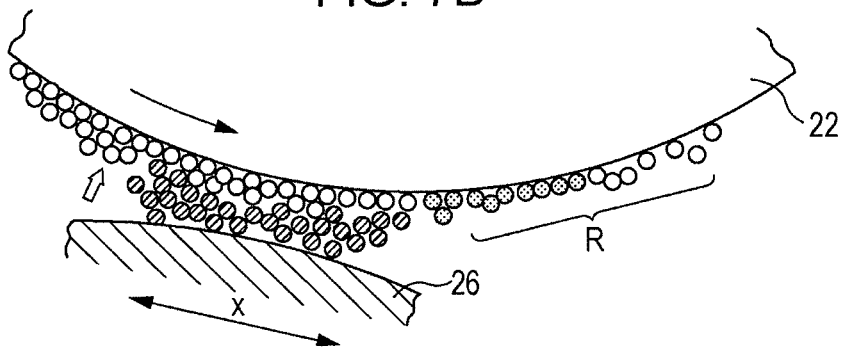
Figure 7C:
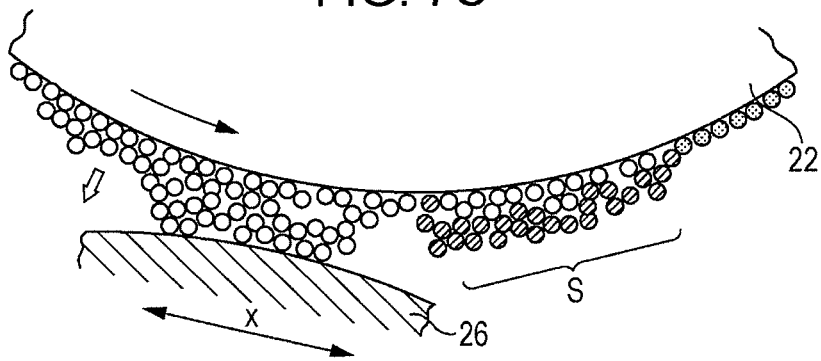

FIGS. 7A to 7C illustrate the movement of the residual toner when a low-frequency electric field is made to act between the electrode member 26 and the developing roller 22. Here, an acting area where a low-frequency electric field effectively acts between the electrode member 26 and the developing roller 22 is represented by x.

FIG. 7A illustrates a state where an electric field that attracts the residual toner toward the electrode member 26 acts. In this case, the toner is attracted toward the electrode member 26 and the distribution of toner particles becomes sparse in the acting area x. In FIG. 7A, shaded toner particles are attracted toward the electrode member 26 while some toner particles (dotted toner particles in FIG. 7A) remain on the developing roller 22, and a clearance is formed therebetween. Then, as the developing roller 22 is rotated, the dotted toner particles are transported downstream from the acting area x, and new toner particles (indicated by open circles in FIG. 7A) are transported to the acting area x and fill in the clearance. Therefore, the distribution of toner particles becomes dense. In this case, a layer with a small amount of toner (i.e., the dotted toner particles in FIG. 7A) is formed in a portion on the developing roller 22 which is downstream of the acting area x, and forms a recess R to which a small amount of toner is attached, described below, between the stripe-shaped projections S (see FIG. 7B).

Then, as illustrated in FIG. 7B, when an electric field that attracts toner toward the developing roller 22 acts, a toner layer in which the clearance in the acting area x is filled and in which the distribution of toner particles becomes dense (including the shaded toner particles and the toner particles indicated by open circles in FIG. 7B) is attracted toward the developing roller 22. As the developing roller 22 is rotated, the toner layer is moved to the downstream side.

FIG. 7C illustrates a state where an electric field that attracts toner toward the electrode member 26 acts again and the distribution of toner particles in the acting area x becomes sparse in a manner similar to that in FIG. 7A. In this case, since the toner layer formed in FIG. 7B in which the distribution of toner particles is dense is moved in accordance with the rotation of the developing roller 22, the toner layer in which the distribution of toner particles is dense forms a projection S in a portion downstream of the acting area x.

By the repetition of the above operation, a recess R having a length corresponding to a half period of the low-frequency electric field (the time during which an electric field that attracts toner toward the electrode member 26 within the low-frequency electric field acts) and having substantially no toner, and a projection S having a length corresponding to the remaining half period of the low-frequency electric field (the time during which an electric field that attracts toner toward the developing roller 22 within the low-frequency electric field acts) and having toner layers stacked are repeatedly formed in a portion on the developing roller 22 downstream of the electrode member 26. Therefore, a pattern of successive stripes is formed.

The stripe pattern formed on the developing roller 22 in the above manner is scraped off in a nip portion between the supply roller 23 and the developing roller 22. The toner scraped off from the developing roller 22 drops into the container 21 in the manner as illustrated in FIG. 5. After that, the toner in the container 21 is again supplied for development through the supply roller 23.

Next, the reason that the residual toner on the developing roller 22 is scraped off will be described.

In general, during the developing operation, toner moves in accordance with the image on the photoconductor 10. For example, for a solid color image, a large amount of toner on the developing roller 22 is moved to the photoconductor 10 while, for a highlight image, only a small amount of toner on the developing roller 22 is moved to the photoconductor 10. As a result, after the developing operation is performed, the residual toner on the developing roller 22 exhibits a distribution of toner amount in accordance with a developed image.

Scraping off the residual toner from the developing roller 22 on which the distribution of toner amount remains and developing a subsequent image using new supplied toner may reduce the occurrence of degradation in image quality such as ghosting in an image. However, if the residual toner is not sufficiently scraped off, the new toner supplied to the developing roller 22 may be influenced by the residual toner. For this reason, for example, when a highlight image is to be formed after a solid color image is formed, the preceding solid color image slightly appearing on the output highlight image, which is called ghosting, may occur.

In this exemplary embodiment, a low-frequency electric field is made to act on the residual toner that remains on the developing roller 22 after the developing operation is performed to form stripe-shaped projections. Therefore, the performance of scraping off the residual toner by using the supply roller 23 may be improved, and the occurrence of ghosting may be suppressed or reduced.

Consideration will now be given of the size of the stripe-shaped recesses and stripe-shaped projections formed as above in the developing device 20. The moving distance of the developing roller 22, which corresponds to the time during which an electric field component that attracts the residual toner on the developing roller 22 toward the electrode member 26 within the low-frequency electric field acts, is equal to the width of a recess in the rotation direction of the developing roller 22. On the other hand, the moving distance of the developing roller 22, which corresponds to the time during which an electric field component that attracts the residual toner on the developing roller 22 toward the developing roller 22 within the low-frequency electric field acts, is equal to the width of a projection in the rotation direction of the developing roller 22. The following description will be given using the width of a recess and the width of a projection.

The width dimensions of a recess and a projection may affect the peripheral speed of the developing roller 22. For a low-frequency electric field having a constant frequency, the width dimensions of a recess and a projection are generally large if the peripheral speed is high. If the peripheral speed is low, however, the width dimensions of a recess and a projection are generally small. Therefore, the low-frequency electric field has desirably a frequency f (Hz) given by $f=v/L$, where L denotes the length (mm) of one period of a stripe pattern (which is equivalent to one period of stripe-shaped projections and which is given by width dimension of recess+ width dimension of projection) and v denotes the peripheral speed (mm/second) of the developing roller 22.

For example, if the length L of one period of a stripe pattern is 1 mm as, for example, the minimum visually observable size, $f=v/1$. Therefore, the value of the frequency f is less than or equal to this value. If the frequency f is excessively high, no visually observable stripe pattern is formed. At a high frequency, in addition, toner vibrates a small amount at that position. Thus, the toner is not allowed to build up by the electrode member 26, and no stripe pattern is formed downstream of the electrode member 26. Therefore, a low frequency to some extent is applied as the frequency f of the low-frequency electric field.

Next, the width of a projection will be described in detail.

A low-frequency electric field according to this exemplary embodiment is configured such that an electric field that attracts the toner on the developing roller 22 toward the electrode member 26 and an electric field that attracts the toner on the developing roller 22 toward the developing roller 22 are alternately made to act, and the frequency f (Hz) of the low-frequency electric field may be determined in the following way.

Now, when the peripheral speed of the developing roller 22 is represented by v (mm/second) and the length of one period of stripe-shaped projections is about 4 mm (the widths of a stripe-shaped recess and a stripe-shaped projection are about 2 mm), the frequency f is given by $f=v/4$. For example, when the peripheral speed v of the developing roller 22 is 330 mm/second, the frequency f is 82.5 Hz.

Figure 8A:
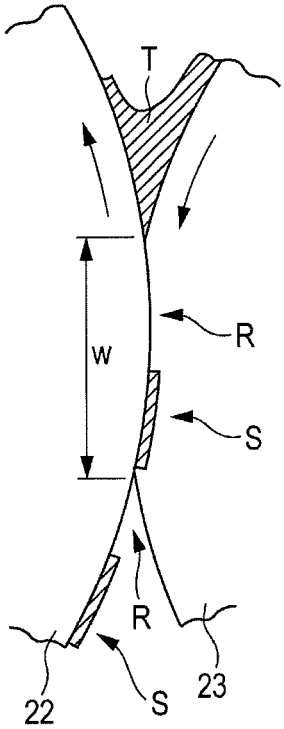
FIG. 8A is schematic enlarged view of a portion where a supply roller and a developing roller come into contact with each other.

Here, the width dimensions of a stripe-shaped recess and a stripe-shaped projection are 2 mm for the following reasons:

FIG. 8A illustrates a stripe pattern formed in a portion (nip portion) where the developing roller 22 and the supply roller 23 according to this exemplary embodiment are in contact with each other (or recesses R and projections S that are sequentially formed). In this case, the length (contact width w) of the nip portion in the rotation direction of the developing roller 22 is, for example, 4.2 mm. Therefore, the width dimension of each of a stripe-shaped recess R and a stripe-shaped projection S is substantially half the contact width of the nip portion, i.e., 2 mm.

It is now assumed that, as illustrated in FIG. 8A, a set of a stripe-shaped recess R and a stripe-shaped projection S has entered the nip portion between the developing roller 22 and the supply roller 23. Specifically, when a recess R and a projection S are positioned in the downstream and upstream sides of the nip portion in the rotation direction of the developing roller 22, respectively, the effect of scraping off stripe-shaped projections S by using the supply roller 23 may be as follows.

The supply roller 23 holds on an outer periphery thereof toner to be supplied from the supply roller 23 to the developing roller 22. In the nip portion, a recess R is followed by a projection S. In this portion, because substantially all the toner on the supply roller 23 has been moved to the developing roller 22, and substantially no toner or only a small amount of toner remains on the surface of the supply roller 23. Therefore, the surface of the supply roller 23 comes into direct contact with the surface of the developing roller 22 with respect to the projection S, and the projection S is pushed substantially from the surface of the developing roller 22, resulting in the projection S being easily scraped off.

In this exemplary embodiment, the length of one period of stripe-shaped projections S (which corresponds to the width dimension of a set of a stripe-shaped recess R and a stripe-shaped projection S) is set to be substantially equal to the length of the nip portion between the developing roller 22 and the supply roller 23. However, the present invention is not limited to this example, and a stripe pattern having a width dimension of a set of a recess R and a projection S that allows the projection S to be included in the nip portion when the width dimension of the recess R is greater than or equal to the width dimension of the projection S may be used. In this case, the toner on the surface of the supply roller 23 is moved to the developing roller 22 at a stripe-shaped recess R, and the exposed portion of the supply roller 23 from which the toner has been removed comes into contact with a projection S that follows the recess R, and the performance of scraping off the projection S is exerted. If the projection S is longer than the nip portion, the projection S may extend over the entirety of the nip portion. In this case, the performance of scraping off the projection S may be lower than when the projection S is shorter than the nip portion.

In the above stripe pattern, the width of the projection S may be small but is desirably determined as follows in terms of the surface characteristics of the supply roller 23.

Figure 8B:
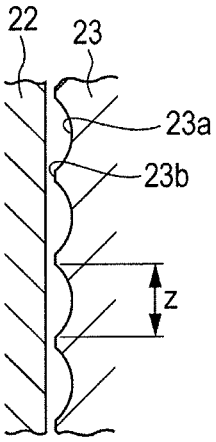
FIG. 8B is a cross-sectional enlarged view of the supply roller.
Figure 8C:
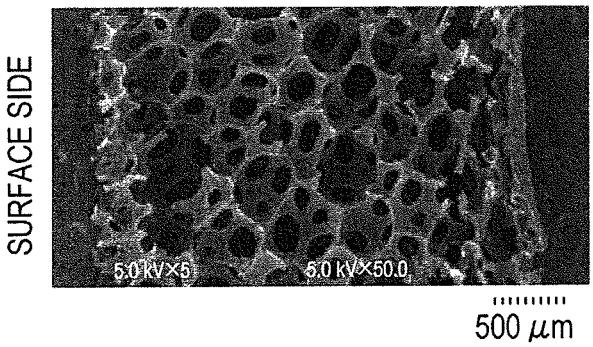
FIG. 8C is an electron micrograph of the cross section of the supply roller.

FIG. 8B is a schematic enlarged view of a portion where the supply roller 23 and the developing roller 22 are in contact with each other according to this exemplary embodiment. The surface of the supply roller 23 has foam cells 23*a* and a framework 23*b* connecting the cells 23*a*. FIG. 8C illustrates an electron micrograph of the cross section of the supply roller 23, and the left side in FIG. 8C corresponds to the surface side.

The supply roller 23 having the above configuration may reduce the performance of scraping off projections S from the developing roller 22 if a projection S is included in one of the cells 23*a* each having a width z. Therefore, it is desirable that the width dimension of a projection S exceed the width z of the cells 23*a*. The width z of the cells 23*a* is generally about 0.3 mm, and therefore it is desirable that the width of a projection S is greater than 0.3 mm.

In general, image fogging or density non-uniformity with a pitch of 0.5 mm or more in the imaging direction may be visually observed. A stripe pattern including recesses R and projections S each having a width of 0.5 mm or more may be readily visually observed. A width of 0.5 mm is larger than the width d of the cells 23*a* of the supply roller 23. Therefore, desirably, the total width of a set of a stripe-shaped recess R and a stripe-shaped projection S is greater than or equal to 1 mm.

Accordingly, in this exemplary embodiment, if the peripheral speed v of the developing roller 22 is 330 mm/second, the frequency f of the low-frequency electric field has an upper limit of 330 Hz when the length of one period of stripe-shaped projections S is 1 mm, and has a lower limit of 41.25 Hz when the contact width between the developing roller 22 and the supply roller 23 is 4 mm and when the length of one period is 8 mm where each of the projection S has a width of 4 mm.

More preferably, the upper limit is 82.5 Hz when the length of one period is 4 mm in order to ensure a clear stripe pattern and a certain height of projections S even in a state where the amount of residual toner is small.

The gap between the electrode member 26 and the developing roller 22 may be large or small.

FIGS. 9A to 9D illustrate a stripe pattern obtained when the gap D between the electrode member 26 and the developing roller 22 is large. Here, it is assumed that residual toner having a thickness Tt is deposited on the developing roller 22, and an amount of toner corresponding to a region $\alpha$ is transported every half period of the low-frequency electric field. The gap D between the electrode member 26 and the developing roller 22 satisfies $D>2Tt$, and is large enough that toner attracted to the electrode member 26 does not come into contact with the developing roller 22 within one period of the low-frequency electric field.

Figure 9A:
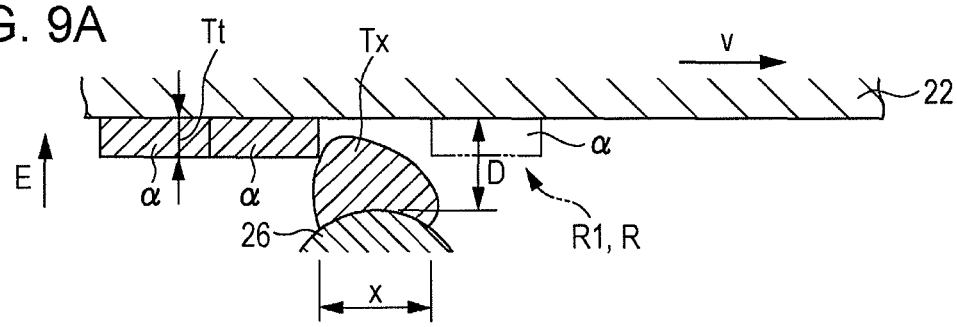
FIGS. 9A to 9D schematically illustrate the process for forming stripe-shaped projections when the gap between the electrode member and the developing roller is large.

In the above conditions, as illustrated in FIG. 9A, when a low-frequency electric field E acts in a direction in which toner is attracted toward the electrode member 26, an amount of toner corresponding to one period is attracted in the acting area x of the electrode member 26. In this case, the region $\alpha$ (in FIG. 9A, a portion that is indicated by a two-dot chain line and that is a portion where toner would exist if the toner were not attracted to the electrode member 26) corresponding to the toner attracted to the electrode member 26 is positioned downstream of the electrode member 26, and forms a first recess R1. Since the toner to be transported by the developing roller 22 moving at the peripheral speed v is transported from left to right in FIG. 9A, the toner clogging (a portion Tx illustrated in FIG. 9A) in the acting area x is configured such that toner whose upstream portion is thicker is attracted to the electrode member 26.

Figure 9B:
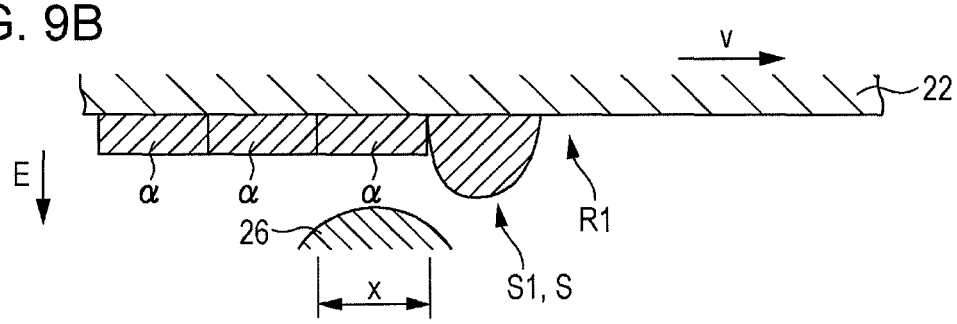

Then, as illustrated in FIG. 9B, when the low-frequency electric field E is reversed, the toner attracted to the electrode member 26 in the acting area x illustrated in FIG. 9A is attracted toward the developing roller 22 and is transported, and a first projection S1 produced by attaching toner in a projecting manner is formed on the developing roller 22 downstream of the electrode member 26. At this time, new toner has arrived at the position facing the electrode member 26.

Figure 9C:
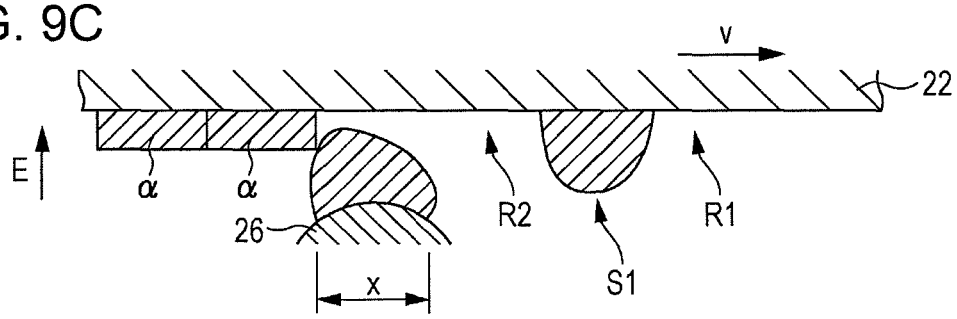
Figure 9D:
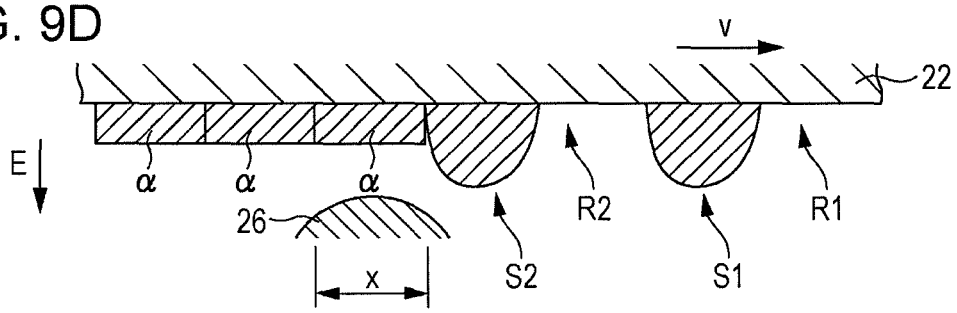

When the low-frequency electric field E is further reversed, as illustrated in FIG. 9C, the toner is attracted toward the electrode member 26, and a second recess R2 is formed on the developing roller 22 downstream of the electrode member 26. Then, as illustrated in FIG. 9D, when the direction of the low-frequency electric field E is reversed to a direction in which the toner is attracted toward the developing roller 22, the toner attracted to the electrode member 26 in FIG. 9C is attracted toward the developing roller 22, and a second projection S2 is formed on the developing roller 22 downstream of the electrode member 26.

In this manner, if the gap D between the electrode member 26 and the developing roller 22 is sufficiently ensured, toner is stably attracted to the electrode member 26. This may ensure that projections S having a stable shape are formed.

FIGS. 10A to 10D illustrate a stripe pattern obtained when the gap D between the electrode member 26 and the developing roller 22 is small. Here, the gap D between the electrode member 26 and the developing roller 22 satisfies D<2Tt, and is small enough that the toner attracted to the electrode member 26 fills in the gap D between the electrode member 26 and the developing roller 22 within one period of the low-frequency electric field.

Figure 10A:
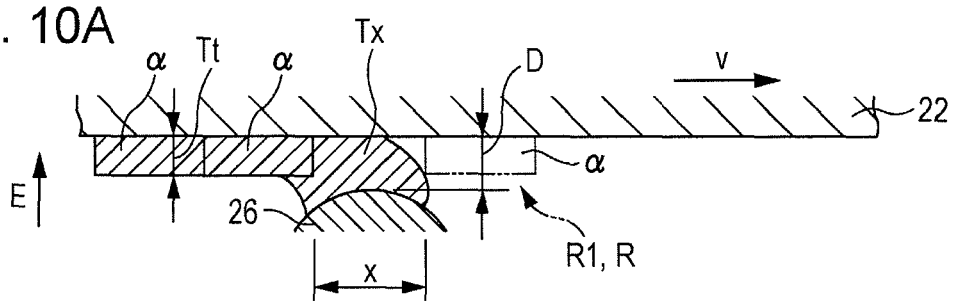
FIGS. 10A to 10D schematically illustrate the process for forming stripe-shaped projections when the gap between the electrode member and the developing roller is small.

In the above conditions, as illustrated in FIG. 10A, when the low-frequency electric field E acts in a direction in which toner is attracted toward the electrode member 26, an amount of toner corresponding to one period is attracted in the acting area x of the electrode member 26. In this case, a region a (in FIG. 10A, a portion that is indicated by a two-dot chain line and that is a portion where toner would exist if the toner were not attracted to the electrode member 26) corresponding to the toner attracted to the electrode member 26 is positioned downstream of the electrode member 26, and forms a first recess R1. Since the toner to be transported by the developing roller 22 moving at the peripheral speed v is transported from left to right in FIG. 10A, the toner attracted to the electrode member 26 is configured such that a downstream portion of the toner is blocked from moving, and toner clogging (a portion Tx illustrated in FIG. 10A) that extends in the upstream direction occurs in the electrode member 26.

Figure 10B:
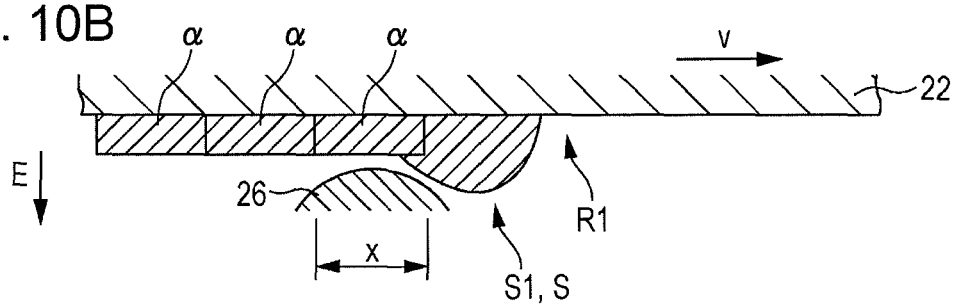

Then, as illustrated in FIG. 10B, when the low-frequency electric field E is reversed, the toner attracted to the electrode member 26 illustrated in FIG. 10A is attracted toward the developing roller 22 and is transported, and a first projection S1 produced by attaching the toner in a projecting manner is formed on the developing roller 22 downstream of the electrode member 26. At this time, new toner has arrived at the position facing the electrode member 26.

Figure 10C:
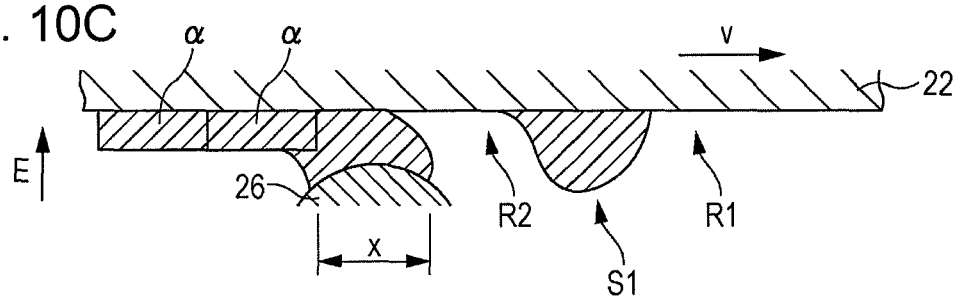
Figure 10D:
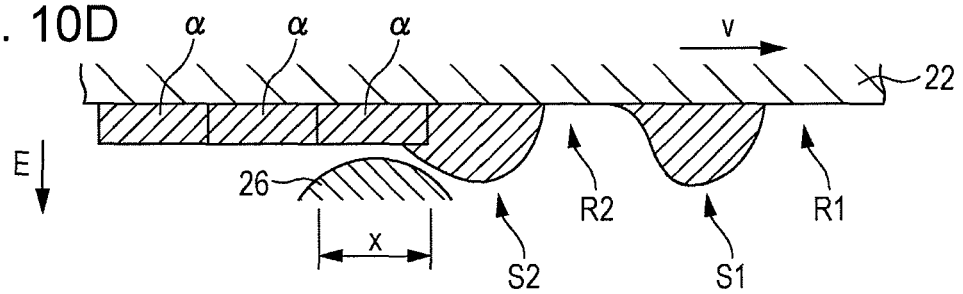

When the low-frequency electric field E is further reversed, as illustrated in FIG. 10C, the toner is attracted toward the electrode member 26, and a second recess R2 is formed on the developing roller 22 downstream of the electrode member 26. In this case, the first projection S1 is located on the developing roller 22 downstream of the second recess R2. The first projection S1 is configured such that the trailing end of the first projection S1 extends in the upstream direction. Then, as illustrated in FIG. 10D, when the direction of the low-frequency electric field E is reversed to a direction in which the toner is attracted toward the developing roller 22, the toner attracted to the electrode member 26 in FIG. 10C is attracted toward the developing roller 22, and a second projection S2 is formed on the developing roller 22 downstream of the electrode member 26.

In this manner, if the gap D between the electrode member 26 and the developing roller 22 is small, a stripe pattern is likely to be formed in a shape in which the trailing ends of, particularly, projections S extends. However, it is to be understood that even in this shape, the scraping performance may be sufficiently ensured.

Therefore, it is more preferable that the gap between the electrode member 26 and the developing roller 22 be sufficiently large, and an appropriate gap may be examined by an experiment or the like and may be selected.

The image forming apparatus according to this exemplary embodiment has been described in the context of a single-color image forming apparatus. However, the present invention is not limited thereto, and a multiple-color image forming apparatus may be used.

In this exemplary embodiment, a roller-shaped member is used as the electrode member 26, by way of example. The roller-shaped member is preferably arranged fixedly but may be rotatably arranged. When the electrode member 26 is rotatably arranged, at least a portion of the toner attracted toward the electrode member 26 is moved to a position displaced from the acting area of the low-frequency electric field. In this case, a stripe pattern may be formed when the toner has reached the acting area of the low-frequency electric field in accordance with the rotation of the electrode member 26, or the toner may drop from the electrode member 26 during the rotation of the electrode member 26. In addition, while the electrode member 26 is disposed along the rotational axis of the developing roller 22, the electrode member 26 may be disposed diagonally with respect to the rotational axis of the developing roller 22. In this case, it is to be noted that the low-frequency electric field acting between the electrode member 26 and the developing roller 22 is substantially uniform in the longitudinal direction of the electrode member 26.

In this exemplary embodiment, a low-frequency electric field whose polarity alternately changes periodically at a low frequency may be used. For example, a rectangular wave having a duty ratio of 50%, a sine wave, or the like may be used. Alternatively, the following wave may also be used.

A modification of the low-frequency electric field according to this exemplary embodiment will be described hereinafter.

Figure 11A:
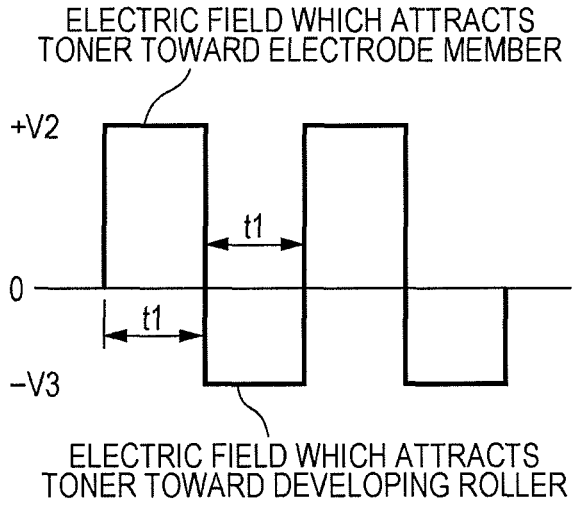
FIG. 11A illustrates a modification of the low-frequency electric field.

FIG. 11A illustrates a modification of the low-frequency electric field, and the central potential is shifted to one side. Here, for example, a potential waveform of the electrode member 26 with respect to the developing roller 22 when negatively charged toner is used as toner is illustrated. The amplitude of an electric field component that attracts toner toward the electrode member 26 is larger than the amplitude of an electric field component that attracts toner toward the developing roller 22. That is, one of the amplitudes is +V2, and the other amplitude is −V3 (|+V2|≥|−V3|), where the acting times are t1.

The effect of the electric field may be as follows: Shifting the central potential may increase the force of attracting toner toward the electrode member 26. In general, toner charged to a reverse polarity may be increased in residual toner due to charging or developing. Additionally, a charge distribution is broad. Thus, it is desirable that toner be scraped off strongly from the developing roller 22 with the toner being more strongly attracted toward the electrode member 26, resulting in a larger amount of toner being easily scraped off from the developing roller 22.

Figure 11B:
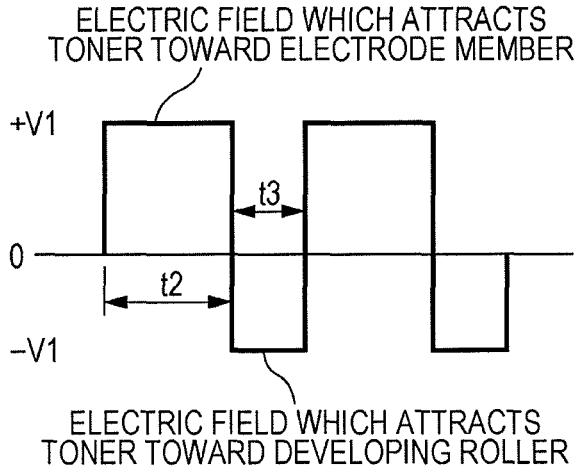
FIG. 11B illustrates another modification of the low-frequency electric field.

FIG. 11B illustrates another modification of the low-frequency electric field, in which the duty ratio is changed from 50%. Here, when negatively charged toner is used, an amplitude of +V1 and an amplitude of −V1 are applied, and an acting time t2 of an electric field that attracts toner toward the electrode member 26 is longer than an acting time t3 of an electric field that attracts toner toward the developing roller 22 (t2>t3).

Figure 11C:
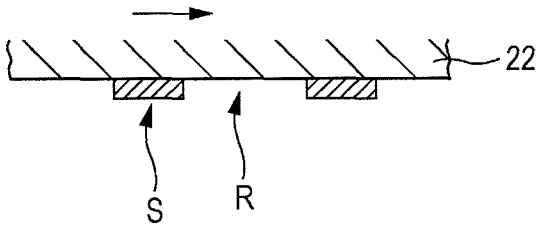
FIG. 11C illustrates stripe-shaped projections formed by using the low-frequency electric field illustrated in FIG. 11B.

The action of the electric fields described above allows, as illustrated in FIG. 11C, a stripe pattern having recesses R longer than projections S to be formed on the developing roller 22 because a stripe-shaped recess R is formed during the acting time t2 of the electric field that attracts toner toward the electrode member 26, which is longer. The action of the electric fields described above also allows a toner layer having a larger layer thickness to be formed on projections S.

Therefore, even if the amount of residual toner is small, the performance of scraping off the residual toner may be sufficiently ensured.

In this exemplary embodiment, a dc component is used as a developing electric field, and a low-frequency electric field is supplied by the low-frequency power source 34 (see FIG. 5), by way of example. However, for example, an electric field in which an ac component is superimposed on a dc component may be used as a developing electric field. In this case, a low-frequency electric field may be created by taking into account the ac component of the developing electric field.

In general, for example, like developing electric fields used in general developing devices and the like, if a high-frequency electric field (for example, 2 kHz) is made to act between the developing roller 22 and the electrode member 26, toner is transported in accordance with the rotation of the developing roller 22 with the toner repeatedly vibrating at that position. The effect of building up of subsequent toner by using the electrode member 26 is not exerted, and it may be difficult to deposit toner on the electrode member 26. As a result, the residual toner is transported to the developing roller 22 downstream of the electrode member 26 substantially as it is, and no stripe pattern may be formed.

In order to form stripe-shaped projections, a low-frequency electric field is made to act between the electrode member 26 and the developing roller 22 by using the low-frequency power source 34. However, if a high-frequency electric field is used as a developing electric field, it may be necessary to form a low-frequency electric field on the basis of the high-frequency electric field. However, it may be difficult to form such an electric field, and a simple method is desired.

Figure 12:
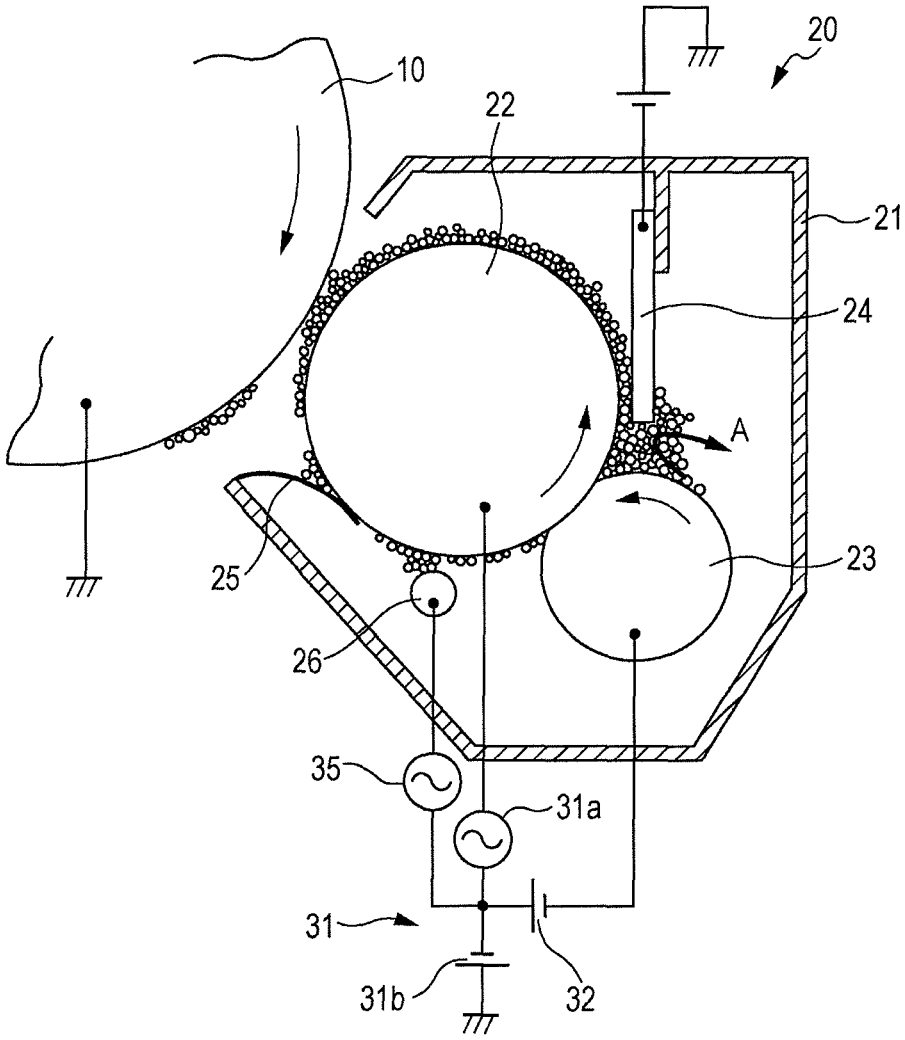
FIG. 12 illustrates an overview of a developing device according to a modification.

This method is illustrated in FIG. 12. In FIG. 12, a developing electric field in which a high-frequency component is superimposed on a dc component is supplied to the developing roller 22 by using a development power source 31 (31*a* and 31*b*). In addition, a power source 35 for making, separately from the developing electric field, a high-frequency component having a frequency close to that the high-frequency component of the developing electric field act on the electrode member 26 is connected in a manner as illustrated in FIG. 12. Thus, a beat component that is the difference between both high-frequency components may equivalently act between the electrode member 26 and the developing roller 22. The difference between both frequency components equivalently acting as the low-frequency power source 34 (see FIG. 5) allows stripe-shaped projections to be formed.

Second Exemplary Embodiment

Figure 13:
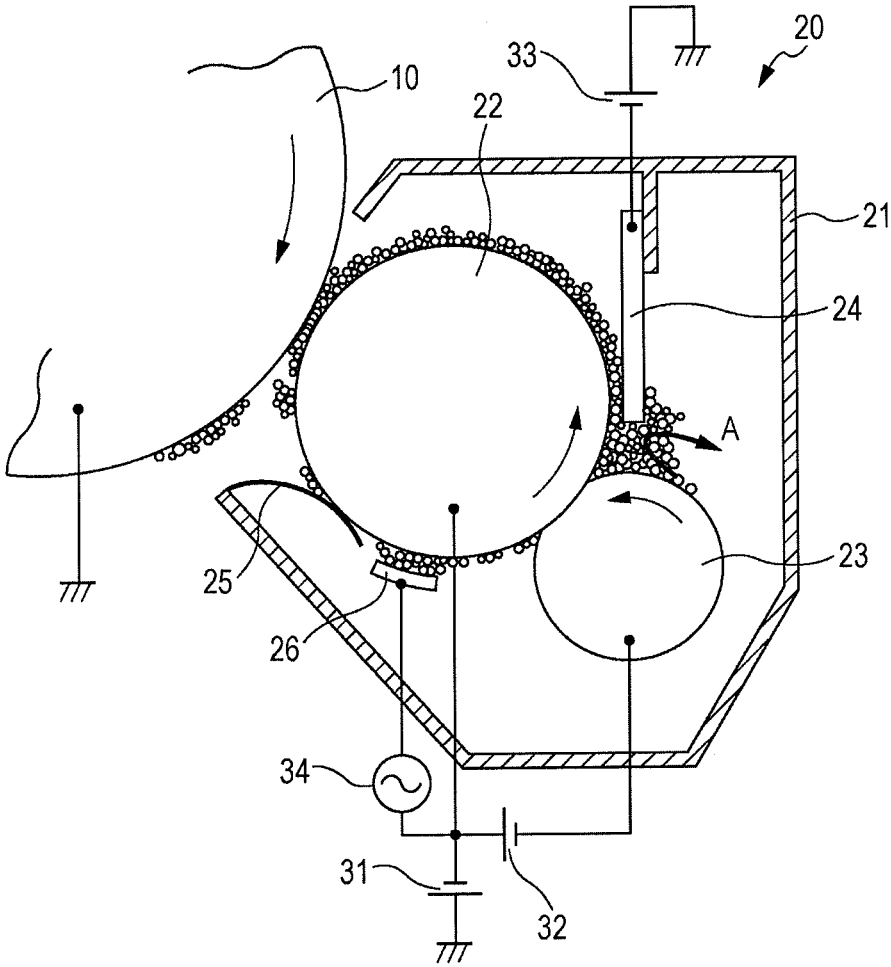
FIG. 13 illustrates an overview of a developing device according to a second exemplary embodiment.

FIG. 13 illustrates an overview of a developing device 20 according to a second exemplary embodiment.

The developing device 20 according to this exemplary embodiment has a configuration substantially similar to that of the developing device 20 (see FIG. 5) according to the first exemplary embodiment, except that the electrode member 26 disposed in a close proximity to the developing roller 22 is formed of a plate-shaped member that is curved in a shape along the outer peripheral surface of the developing roller 22. Elements similar to those in the first exemplary embodiment are represented by the same numerals, and a detailed description will be omitted.

In this exemplary embodiment, a low-frequency electric field is made to act between the electrode member 26 and the developing roller 22, thus allowing the toner on the developing roller 22 to be repeatedly attracted between the developing roller 22 and the electrode member 26, and a stripe pattern occurs on the developing roller 22 downstream of the electrode member 26. While both ends of the electrode member 26 in a direction along the rotation direction of the developing roller 22 are formed in a shape substantially similar to the shape of the outer peripheral surface of the developing roller 22, the electrode member 26 may be shaped so that, for example, both ends of the electrode member 26 are away from the developing roller 22. In this case, the risk of the movement of toner being affected by an end of the electrode member 26 may be reduced.

In this exemplary embodiment, particularly, the electrode member 26 and the developing roller 22 are arranged substantially parallel to each other. Thus, more preferably, the length of the electrode member 26 in the rotation direction of the developing roller 22 (specifically, the length of the acting area where the low-frequency electric field acts) is greater than or equal to the width (corresponding to the moving distance of the developing roller 22 in its rotation direction, which corresponds to the time during which an electric field component that attracts the residual toner on the developing roller 22 toward the developing roller 22 within the low-frequency electric field acts) of a projection. Therefore, the adhesion of the stripe pattern to the developing roller 22 may be reduced.

FIGS. 14A to 14D, FIGS. 15A to 15E, and FIGS. 16A to 16D schematically illustrate the effect of forming a stripe pattern when the length of an acting area x where the low-frequency electric field acts between the electrode member 26 and the developing roller 22 differs.

Figure 14A:
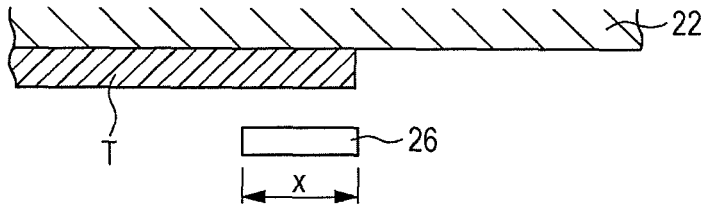
FIGS. 14A to 14D schematically illustrate the movement of toner when an acting area on the electrode member has a size corresponding to the width of a projection.

FIGS. 14A to 14D illustrate a case where the length of the acting area x is equal to the width of a projection S. As illustrated in FIG. 14A, it is assumed that toner T is sequentially transported to the developing roller 22 (a dotted portion refers to new toner T to be transported to the developing roller 22).

Figure 14B:
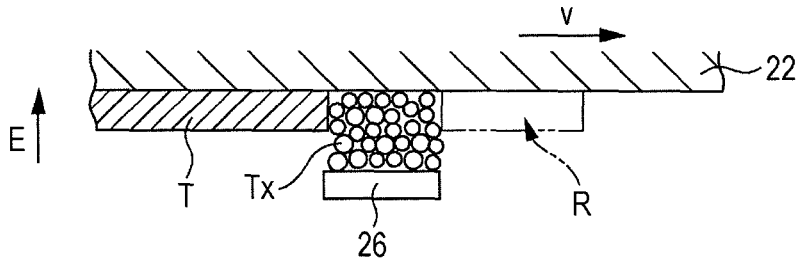

When a low-frequency electric field E that attracts the toner T toward the electrode member 26 acts and the developing roller 22 is rotated at the peripheral speed v, as illustrated in FIG. 14B, the toner T on the developing roller 22 is attracted toward the electrode member 26, and subsequent toner T is also attracted toward the electrode member 26. Thus, a force acting in a direction in which the toner Tx (which is toner in a portion where the attraction effect is exerted by using the low-frequency electric field E) is attracted toward the electrode member 26 is exerted in the acting area x, and toner clogging is formed. In this case, a region (in FIG. 14B, a region indicated by a two-dot chain line) of the toner T to which toner would be transported if the low-frequency electric field E did not act is formed on the developing roller 22 downstream of the electrode member 26, and forms a stripe-shaped recess R.

Figure 14C:
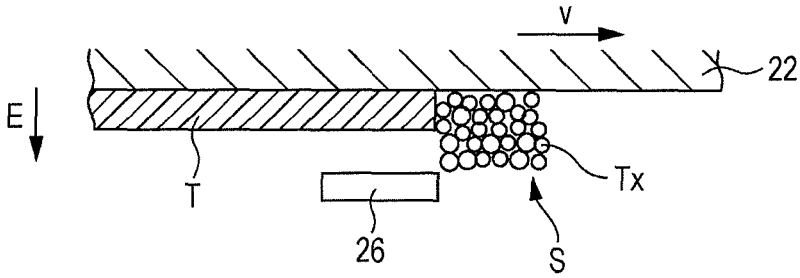

Then, as illustrated in FIG. 14C, when the direction of the low-frequency electric field E is switched to a direction in which the toner T is attracted toward the developing roller 22, the toner clogging in the acting area x illustrated in FIG. 14B is transported to the downstream side, and forms a stripe-shaped projection S. New toner T to be transported arrives at the acting area x.

Figure 14D:
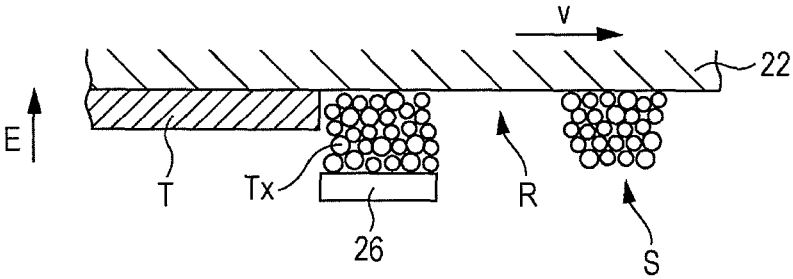

Further, as illustrated in FIG. 14D, when the direction of the low-frequency electric field E is switched to a direction in which the toner T is attracted toward the electrode member 26, toner clogging is formed in the acting area x in a manner similar to that in FIG. 14B. At this time, a new recess R is formed downstream of the acting area x.

By the repetition of the above operation, a stripe pattern having stripe-shaped projections S is formed on the developing roller 22 downstream of the electrode member 26.

Figure 15A:
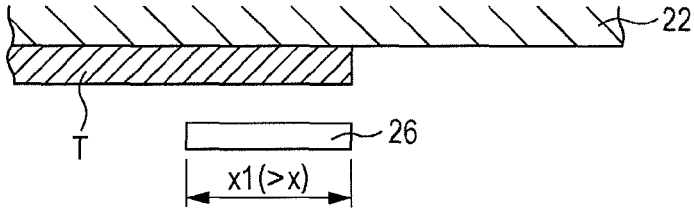
FIGS. 15A to 15E schematically illustrate the movement of toner when an acting area on the electrode member has a size exceeding the width of a projection.

FIGS. 15A to 15E illustrate an example in which the length of an acting area x1 is larger than the width of a projection S (where x1>x). As illustrated in FIG. 15A, it is assumed that toner T is sequentially transported to the developing roller 22 (a dotted portion refers to new toner T to be transported to the developing roller 22).

Figure 15B:
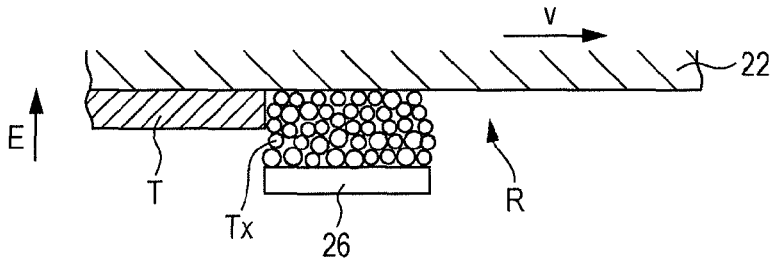

When a low-frequency electric field E that attracts the toner T toward the electrode member 26 acts and the developing roller 22 is rotated at the peripheral speed v, as illustrated in FIG. 15B, the toner T on the developing roller 22 is attracted toward the electrode member 26, and subsequent toner T is also attracted toward the electrode member 26. Thus, a force acting in a direction in which the toner T is attracted toward the electrode member 26 is exerted in the acting area x1, and toner clogging is formed. In this case, a region of the toner T to which toner would be transported if the low-frequency electric field E did not act is formed on the developing roller 22 downstream of the electrode member 26, and a stripe-shaped recess R is formed.

Figure 15C:
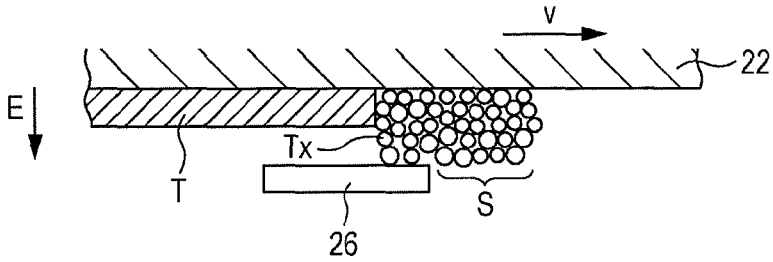

Then, as illustrated in FIG. 15C, when the direction of the low-frequency electric field E is switched to a direction in which the toner T is attracted toward the developing roller 22, the toner clogging in the acting area x1 illustrated in FIG. 15B is transported to the downstream side. However, a portion of the toner clogging remains in the acting area x1, and a portion transported downstream of the acting area x1 forms a projection S. New toner T to be transported arrives at the acting area x1.

Figure 15D:
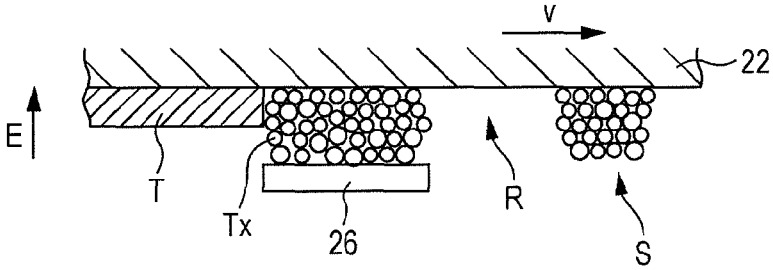

Further, as illustrated in FIG. 15D, when the direction of the low-frequency electric field E is switched to a direction in which the toner T is attracted toward the electrode member 26, the residual toner Tx and the new transported toner T are attracted toward the electrode member 26 in the acting area x1, and new toner clogging is formed. At this time, a new recess R is formed between the projection S transported to the downstream side and the acting area x1.

Figure 15E:
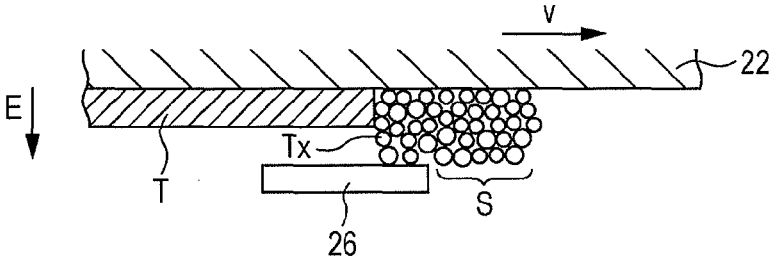

Further, as illustrated in FIG. 15E, when the direction of the low-frequency electric field E is switched to a direction in which the toner T is attracted toward the developing roller 22, a portion of the toner clogging in the acting area x1 illustrated in FIG. 15D passes through the acting area x1, and a projection S is formed.

By the repetition of the above operation, a stripe pattern having stripe-shaped projections S is formed on the developing roller 22 downstream of the electrode member 26.

Figure 16A:
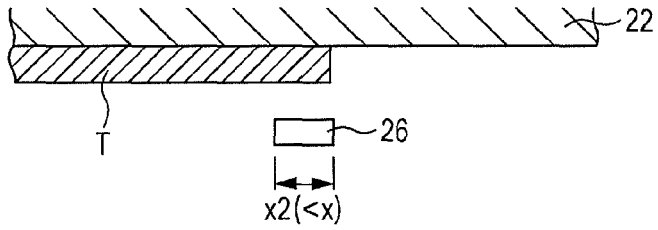
FIGS. 16A to 16D schematically illustrate the movement of toner when an acting area on the electrode member has a size smaller than the width of a projection.

FIGS. 16A to 16D illustrate an example in which the length of an acting area x2 is smaller than the width of the projection S (where x2<x). As illustrated in FIG. 16A, it is assumed that toner T is sequentially transported to the developing roller 22 (a dotted portion refers to new toner T to be transported to the developing roller 22).

Figure 16B:
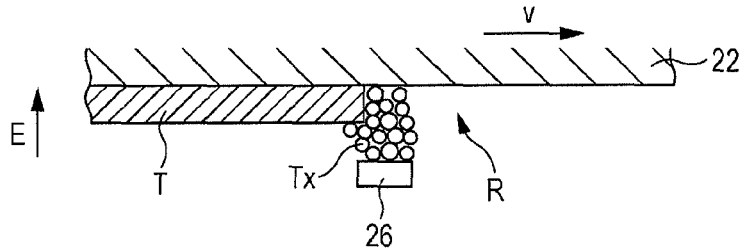

When a low-frequency electric field E that attracts the toner T toward the electrode member 26 acts and the developing roller 22 is rotated at the peripheral speed v, as illustrated in FIG. 16B, the toner T on the developing roller 22 is attracted toward the electrode member 26, and subsequent toner T is also attracted toward the electrode member 26. Thus, toner clogging is formed in the acting area x2. In this case, the toner clogging in the acting area x2 is affected by the force for transporting the subsequent toner T, and extends also upstream of the acting area x2. A region of the toner T to which toner would be transported if the low-frequency electric field E did not act is formed on the developing roller 22 downstream of the electrode member 26, and a stripe-shaped recess R is formed.

Figure 16C:
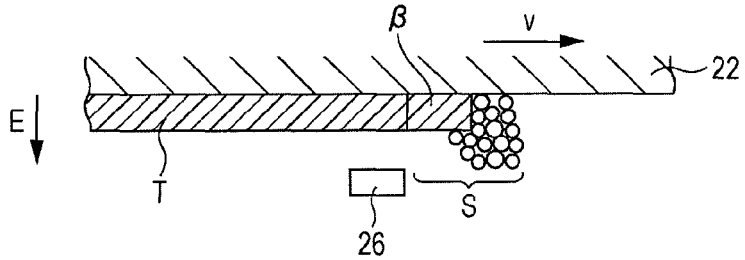

Then, as illustrated in FIG. 16C, when the direction of the low-frequency electric field E is switched to a direction in which the toner T is attracted toward the developing roller 22, the toner clogging in the acting area x2 illustrated in FIG. 16B is transported to the downstream side. In addition, a portion β illustrated in FIG. 16C, that is, a portion that is not affected by the action of the electric field that attracts the toner T toward the electrode member 26, also passes through the acting area x2. Then, the toner clogging in the acting area x2 and the portion β form a stripe-shaped projection S.

Figure 16D:
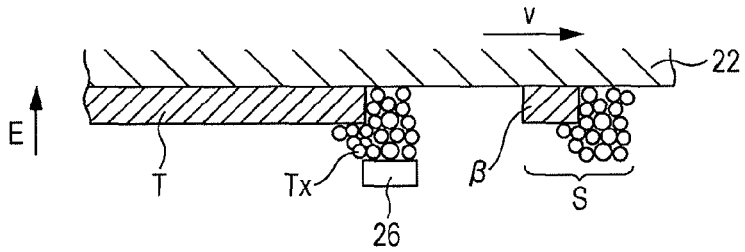

Further, as illustrated in FIG. 16D, when the direction of the low-frequency electric field E is switched to a direction in which the toner T is attracted toward the electrode member 26, toner clogging is formed in the acting area x2 in a manner similar to that in FIG. 16B. At this time, a new recess R is formed downstream of the acting area x2.

By the repetition of the above operation, a stripe pattern having stripe-shaped projections S is formed on the developing roller 22 downstream of the electrode member 26.

Accordingly, if the width of the acting area x is greater than or equal to the width of a projection S, a projection S formed downstream of the acting area x is affected by the action of the electric field that allows the projection S to be attracted toward the electrode member 26 in the range of the acting area x. If the width of the acting area x is less than the width of a projection S, in contrast, a projection S formed downstream of the acting area x also includes a portion that has passed through the acting area x without being affected by the action of the electric field that allows the projection S to be attracted toward the electrode member 26 in the acting area x. Therefore, the adhesion of the toner to the developing roller 22 downstream of the acting area x is smaller when the width of the acting area x is greater than or equal to the width of a projection S than otherwise, and the performance of scraping off the toner from the developing roller 22 may be more effectively exerted. It is therefore preferable that the width of the acting area x be greater than or equal to the width of the projection S.

Even if the width of the acting area x is less than the width of the projection S, as illustrated in, for example, FIG. 16D, a projecting portion is formed on the downstream side in the rotation direction of the developing roller 22. During scraping, a force may be generated for scraping off the projecting portion along the surface of the developing roller 22, and the scraping performance may be improved compared to when no projections S are formed.

The width of the acting area x may be determined in a manner similar to that described above in cases other than this exemplary embodiment, for example, even in the first exemplary embodiment where the electrode member 26 has a curved surface, or even in a case where the electrode member 26 is in contact with the developing roller 22.

Third Exemplary Embodiment

Figure 17A:
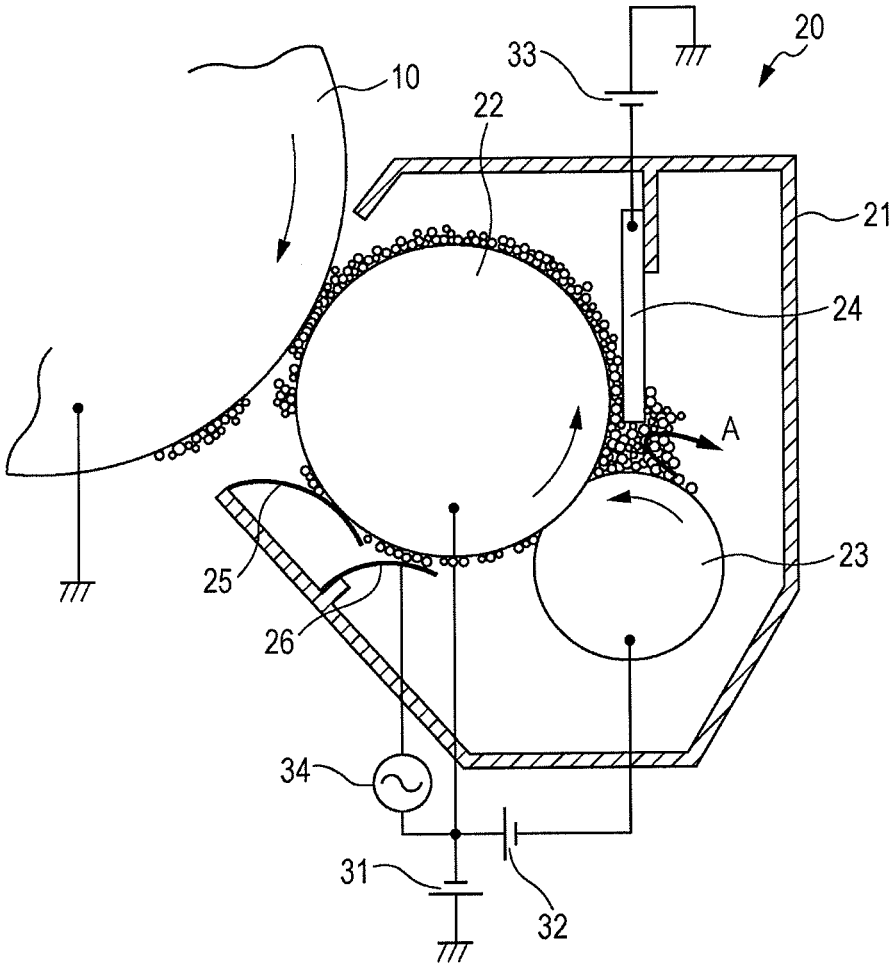
FIG. 17A illustrates an overview of a developing device according to a third exemplary embodiment.
Figure 17B:
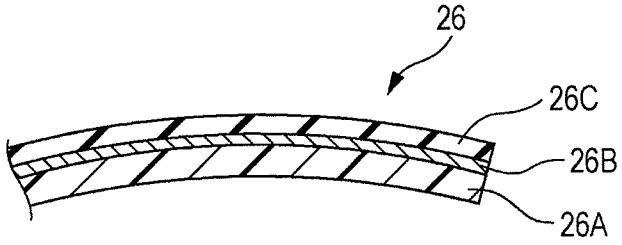
FIG. 17B is a cross-sectional enlarged view of an electrode member.

FIG. 17A illustrates an overview of a developing device 20 according to a third exemplary embodiment, and FIG. 17B is an enlarged view of a portion of the developing device 20 illustrated in FIG. 17A.

The developing device 20 according to this exemplary embodiment has a configuration substantially similar to that of the developing device 20 (see FIG. 5) according to the first exemplary embodiment, except that the electrode member 26 is disposed so as to be in contact with the developing roller 22. Elements similar to those in the first exemplary embodiment are represented by the same numerals, and a detailed description will be omitted.

The electrode member 26 according to this exemplary embodiment may be a sheet-shaped member including an elastically deformable base material 26A such as a polyester sheet, a conductive layer 26B that is formed on a surface of the base material 26A and that has been subjected to conductive processing, and an insulating releasing layer 26C that is formed on a surface of the conductive layer 26B and that is formed of a fluorocarbon resin layer or a polyolefin resin layer having a volume resistivity of, for example, $10^6$ Ω·cm or higher. The electrode member 26 is configured such that an end of the electrode member 26 is fixed to a portion of the container 21 and the other end of the electrode member 26 serves as a free end extending in the rotation direction of the developing roller 22, and the electrode member 26 is in contact with the developing roller 22 at a portion inward from the free end. The length of the electrode member 26 in the rotational axis direction of the developing roller 22 is larger than the effective width of the developing region.

In the above configuration, at least a portion of the electrode member 26 that is in contact with the developing roller 22 is elastically deformed to form a gap between the electrode member 26 and the developing roller 22 in accordance with the amount of toner to build up even when an electric field that attracts toner toward the electrode member 26 acts. Therefore, the behavior of the gap may be appropriately changed in accordance with the amount of toner between the electrode member 26 and the developing roller 22.

Since stripe-shaped projections are stably formed even if the toner attracted to the electrode member 26 is attracted toward the developing roller 22, a stable stripe pattern may be formed on the developing roller 22 downstream of the electrode member 26. Therefore, the performance of scraping off the stripe-shaped projections may be sufficiently exerted.

Fourth Exemplary Embodiment

Figure 18:
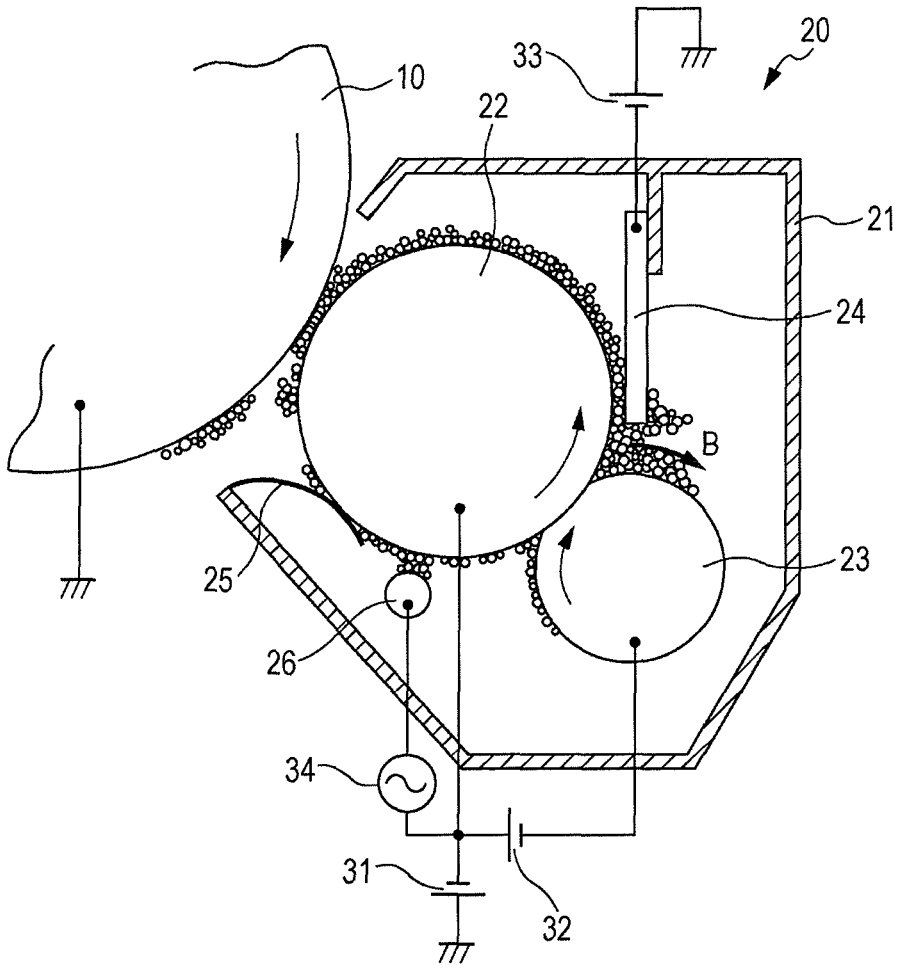
FIG. 18 illustrates an overview of a developing device according to a fourth exemplary embodiment.

FIG. 18 illustrates an overview of a developing device 20 according to a fourth exemplary embodiment.

The developing device 20 according to this exemplary embodiment has a configuration substantially similar to that of the developing device 20 (see FIG. 5) according to the first exemplary embodiment, except that the rotation direction of the supply roller 23 is different from that in the first exemplary embodiment. The supply roller 23 is rotated in the same direction as the developing roller 22 in a portion where the supply roller 23 is in contact with the developing roller 22. Elements similar to those in the first exemplary embodiment are represented by the same numerals, and a detailed description will be omitted.

In this exemplary embodiment, the supply roller 23 is rotated in the same direction as the developing roller 22 in a portion where the supply roller 23 is in contact with the developing roller 22, and there is a difference between the peripheral speeds of the supply roller 23 and the developing roller 22. That is, the rotation direction of the supply roller 23 is different from that in the first exemplary embodiment. Although the toner to be supplied to the developing roller 22 passes between the supply roller 23 and the developing roller 22, the difference in peripheral speed is set so that no load is placed on the toner, and therefore the toner on the developing roller 22 is regulated to a predetermined layer thickness by the layer thickness regulating member 24. In addition, the toner on the developing roller 22 is charged to a predetermined charge amount. In FIG. 18, an arrow B indicates the flow of toner regulated by the layer thickness regulating member 24.

The effect of scraping off stripe-shaped projections on the developing roller 22 in the above configuration will be described.

Figure 19A:
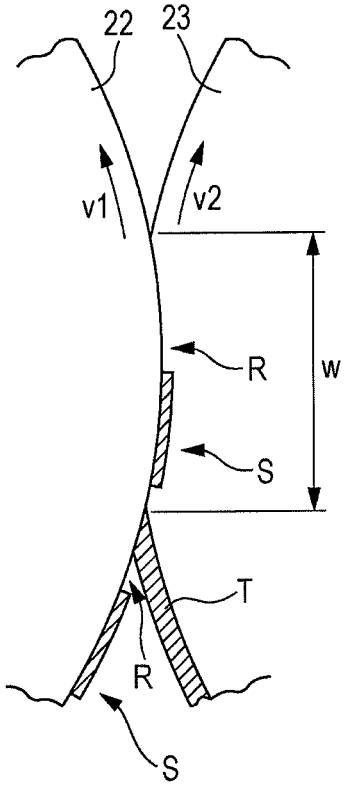
FIG. 19A is a schematic enlarged view of a portion where a supply roller and a developing roller come into contact with each other according to the fourth exemplary embodiment.
Figure 19B:
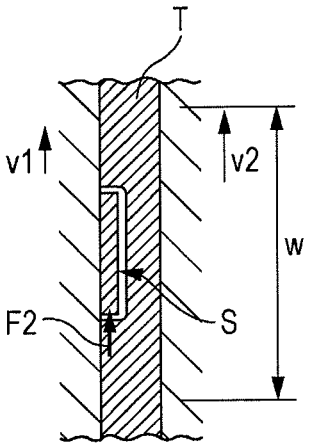
FIG. 19B is an enlarged view of part of the portion illustrated in FIG. 19A.

FIG. 19A illustrates stripe-shaped projections S formed in a portion (nip portion) where the developing roller 22 and the supply roller 23 are in contact with each other according to this exemplary embodiment, and FIG. 19B is an enlarged view of part of the stripe-shaped projections S. In this exemplary embodiment, the toner T to be supplied by the supply roller 23 is transported from bottom in FIGS. 19A and 19B. It is now assumed that a recess R and a projection S exist in a contact portion (a portion having a contact width w in FIGS. 19A and 19B). In this case, the toner on the supply roller 23 reaches the surface of the developing roller 22 in the recess R. Due to the difference between the peripheral speed v1 of the developing roller 22 and the peripheral speed v2 of the supply roller 23, a force in the direction indicated by an arrow F2 in FIG. 19B is exerted on the tip portion of the projection S. Therefore, the effect of scraping off toner occurs, and the residual toner on the developing roller 22 is scraped off. While the peripheral speed of the developing roller 22 is lower than the peripheral speed of the supply roller 23 by way of example, conversely, the peripheral speed of the supply roller 23 may be lower than the peripheral speed of the developing roller 22. Also in this case, similar advantages may be achieved.

Fifth Exemplary Embodiment

Figure 20:
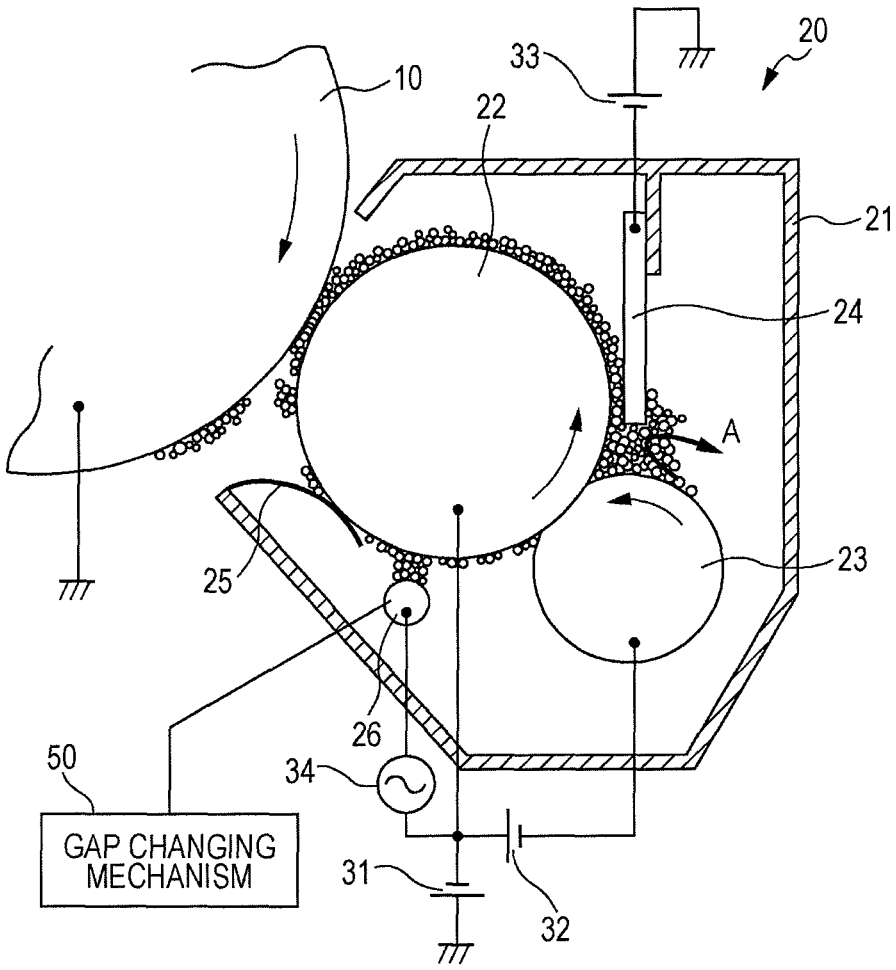
FIG. 20 illustrates an overview of a developing device according to a fifth exemplary embodiment.

FIG. 20 illustrates an overview of a developing device 20 according to a fifth exemplary embodiment.

The developing device 20 according to this exemplary embodiment has a configuration substantially similar to that of the developing device 20 (see FIG. 5) according to the first exemplary embodiment, except that a gap changing mechanism 50 for moving the electrode member 26 is provided to change the gap between the electrode member 26 and the developing roller 22. Elements similar to those in the first exemplary embodiment are represented by the same numerals, and a detailed description will be omitted.

The gap changing mechanism 50 according to this exemplary embodiment has a configuration for moving the electrode member 26 at two positions having different gaps between the electrode member 26 and the developing roller 22. The change of the gap allows the electrode member 26 to be separated apart from the developing roller 22, for example, if the amount of residual toner increases due to the changes in toner or the surface of the developing roller 22 over time. Therefore, stripe-shaped projections may be formed, as desired.

In this exemplary embodiment, the electrode member 26 is moved at two positions in close proximity to the developing roller 22, by way of example. For example, as in the third exemplary embodiment (see FIG. 17), if the electrode member 26 has elasticity, the electrode member 26 may be moved at a position in contact with the developing roller 22 and at a position in close proximity to the developing roller 22. The electrode member 26 may not necessarily be moved at two positions, and may be moved at three or more positions.

In this exemplary embodiment, furthermore, the electrode member 26 is moved by way of example. However, the electrode member 26 may be moved and the magnitude of the low-frequency electric field may be changed. In this case, when the amount of residual toner becomes large, the electrode member 26 may be separated apart from the developing roller 22 and the electric field intensity may be increased.

Sixth Exemplary Embodiment

Figure 21:
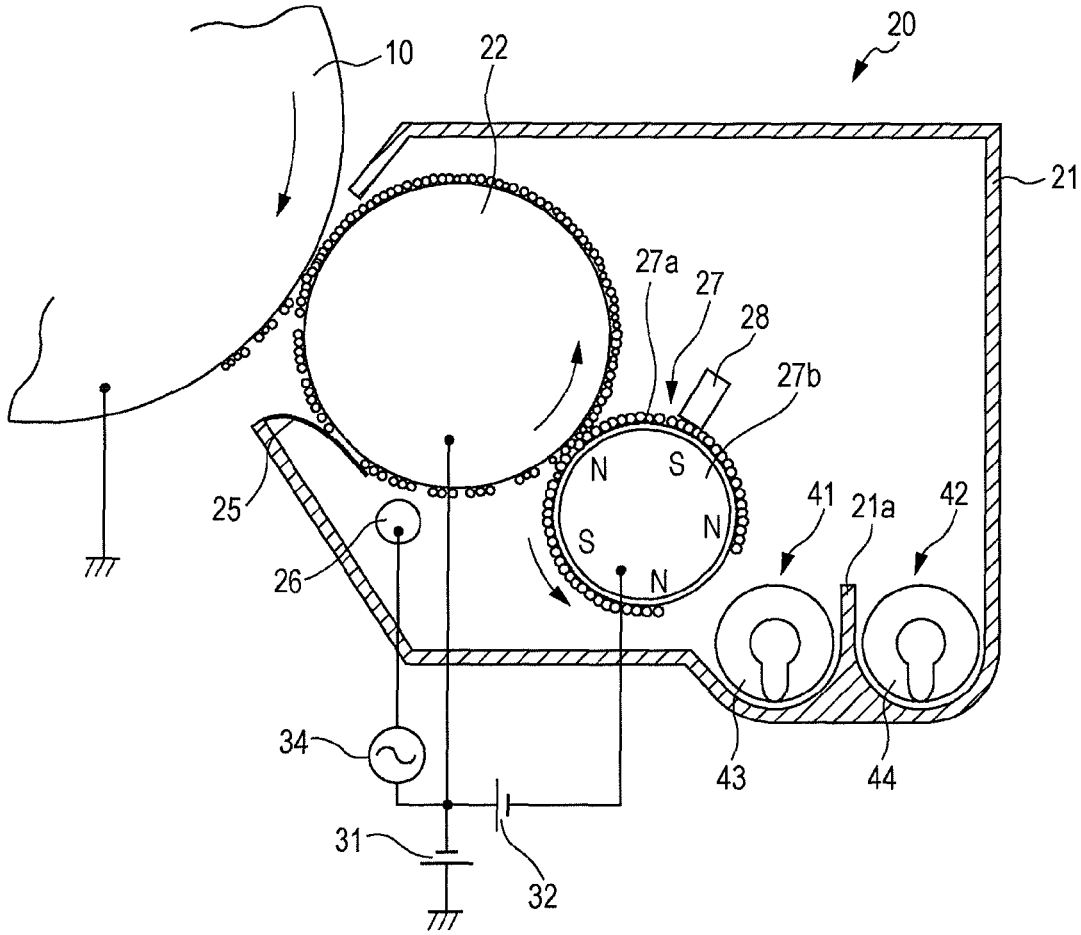
FIG. 21 illustrates an overview of a developing device according to a sixth exemplary embodiment.

FIG. 21 illustrates an overview of a developing device 20 according to a sixth exemplary embodiment.

The developing device 20 according to this exemplary embodiment is different from the developing devices 20 according to the foregoing exemplary embodiments in that two-component developer is used. The developing device 20 according to this exemplary embodiment is configured to supply toner in the two-component developer to the developing roller 22. Elements similar to those in the first exemplary embodiment are represented by the same numerals, and a detailed description will be omitted.

In FIG. 21, the developing device 20 according to this exemplary embodiment includes a developing roller 22 corresponding to an opening in the container 21, and a supply roller 27 provided at a position spaced apart and facing the developing roller 22. The supply roller 27 according to this exemplary embodiment includes a rotatable sleeve 27*a* on a peripheral surface thereof, and a fixed magnetic body 27*b* having magnetic poles appropriately arranged therein.

The developing device 20 according to this exemplary embodiment further includes, behind the supply roller 27, two developer transport paths 41 and 42 arranged in the rotational axis direction of the supply roller 27 for transporting two-component developer. A partition wall 21*a* that is part of the container 21 is formed at the center of the two developer transport paths 41 and 42, and the two developer transport paths 41 and 42 communicate with each other via communication openings (not illustrated) formed in both ends of the two developer transport paths 41 and 42.

Stirring transport members 43 and 44 are provided in the two developer transport paths 41 and 42, respectively, for transporting developer while stirring the developer in the longitudinal direction of the developer transport paths 41 and 42. The stirring transport members 43 and 44 transport the developer in different directions, thereby circularly transporting the developer between the two developer transport paths 41 and 42.

Thus, the supply roller 27 is configured to absorb developer from the developer transport path 41 which is nearer the supply roller 27, hold the developer on the surface thereof, and transport the developer in accordance with the rotation of the sleeve 27*a*. In a portion of the magnetic body 27*b*, magnetic poles of the same polarity are disposed adjacent to produce repulsive magnetic fields, and the repulsive magnetic fields allow the developer on the sleeve 27*a* to be scraped off.

In the developing device 20 having the above configuration, developer is stirred and transported by the stirring transport members 43 and 44 in the developer transport paths 41 and 42, and toner in the developer is therefore charged to a predetermined charge amount. The developer having the charged toner is transported to the supply roller 27. A layer thickness regulating member 28 disposed so as to face the supply roller 27 regulates the amount of developer on the supply roller 27 at a constant value, and the constant amount of developer is transported to a portion where the supply roller 27 and the developing roller 22 face. In the portion where the supply roller 27 and the developing roller 22 face, developer chains are sufficiently created by the effect of the magnetic pole, and a supply electric field is applied by the supply power source 32. Therefore, a predetermined amount of toner in the developer is moved to the developing roller 22.

The toner that has been moved to the developing roller 22 is regulated in quantity, and has been sufficiently charged. Therefore, there is no need to apply charge to the toner. However, an additional member for applying charge, such as a corona charger, may also be provided.

The toner that has reached the developing region in accordance with the rotation of the developing roller 22 is developed by the using the developing electric field between the photoconductor 10 and the developing roller 22, and the residual toner that has passed through the developing region passes through the sealing member 25 and then reaches a portion where the developing roller 22 and the electrode member 26 face. A low-frequency electric field allows stripe-shaped projections to be formed. In the portion where the supply roller 27 and the developing roller 22 face, sufficient developer chains are created on the supply roller 27 side. The chains allow the stripe-shaped projections on the developing roller 22 to be scraped off from the developing roller 22.

Figure 22A:
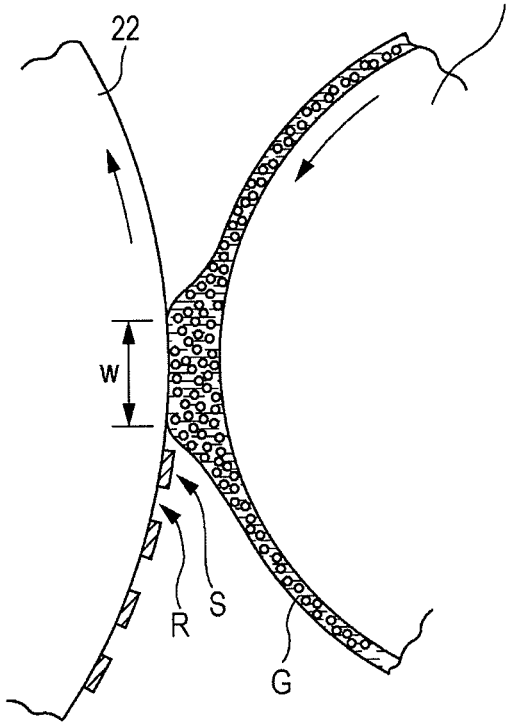
FIG. 22A is a schematic enlarged view of a portion where a supply roller and a developing roller come into contact with each other according to the sixth exemplary embodiment.
Figure 22B:
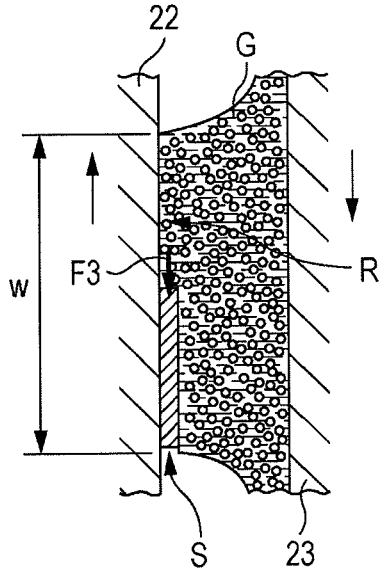
FIG. 22B is an enlarged view of part of the portion illustrated in FIG. 22A.

FIG. 22A illustrates a portion where the developing roller 22 and the supply roller 23 face according to this exemplary embodiment, where a stripe pattern is formed. FIG. 22B is an enlarged view of part of the stripe pattern.

In this exemplary embodiment, in a portion where the developing roller 22 and developer G are in contact with each other (which corresponds to the contact width w), the developer G has reached the surface of the developing roller 22 in a recess R. Thus, a force F3 illustrated in FIG. 22B is exerted on the projection S, and the projection S may be sufficiently scraped off.

Seventh Exemplary Embodiment

Figure 23:
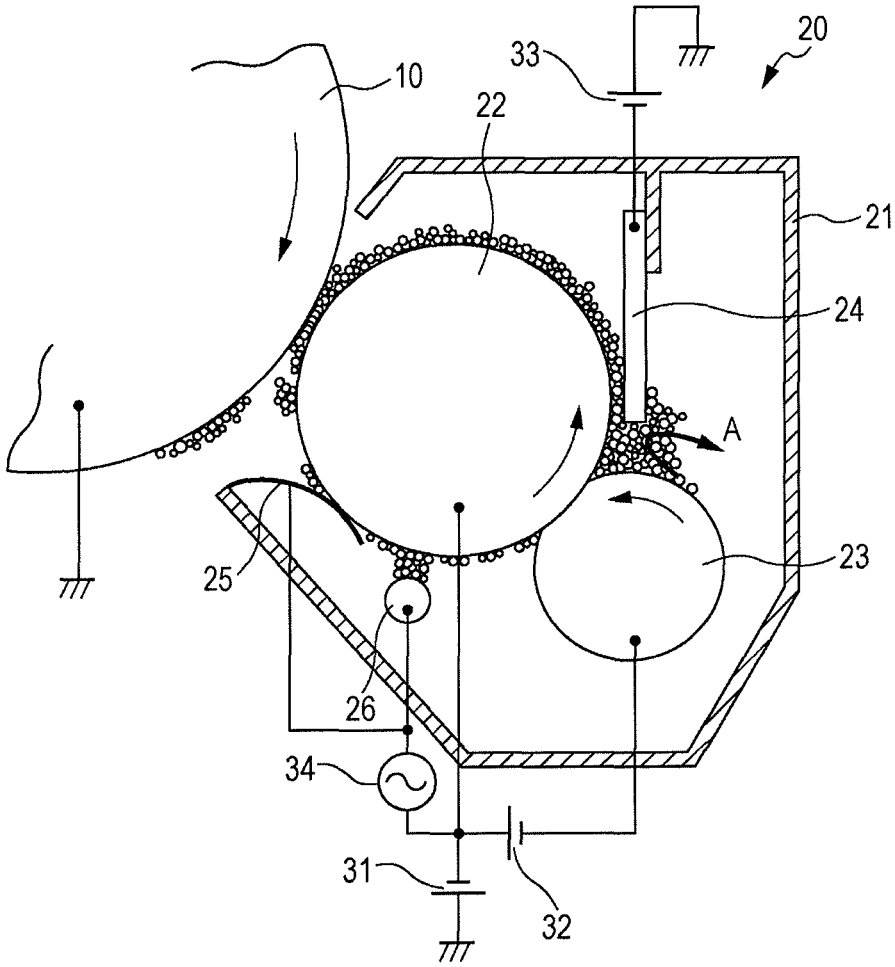
FIG. 23 illustrates an overview of a developing device according to a seventh exemplary embodiment.

FIG. 23 illustrates an overview of a developing device 20 according to a seventh exemplary embodiment.

The developing device 20 according to this exemplary embodiment is different from the developing devices 20 according to the foregoing exemplary embodiments in that electrode members are provided in two positions. In this exemplary embodiment, a sealing member 25 also has a function of an electrode member. A low-frequency power source 34 is connected to the sealing member 25 and an electrode member 26 disposed downstream of the sealing member 25 so that the same low-frequency electric field is made to act between the sealing member 25 and the developing roller 22 and between the electrode member 26 and the developing roller 22. Elements similar to those in the first exemplary embodiment are represented by the same numerals, and a detailed description will be omitted.

The sealing member 25 according to this exemplary embodiment is coated with a conductive coating on a side thereof facing the developing roller 22, and the sealing member 25 and the electrode member 26 are connected to the low-frequency power source 34.

The process for forming stripe-shaped projections on the developing roller 22 having the above configuration will be described with reference to FIGS. 24A and 24B. It is assumed that stripe-shaped projections S formed by the sealing member 25 include a first projection S1, a second projection S2, a third projection S3, a fourth projection S4, a fifth projection S5, and a sixth projection S6 which are sequentially formed with intervals.

Figure 24A:
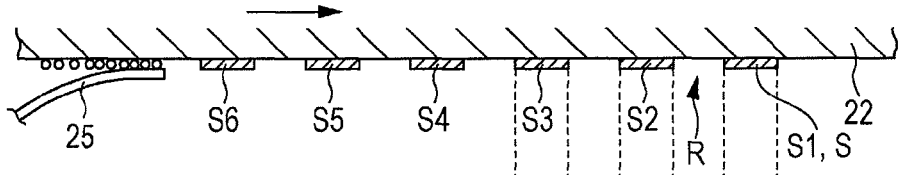
FIG. 24A schematically illustrates a process for forming stripe-shaped projections according to the seventh exemplary embodiment when a single electrode member is used.
Figure 24B:
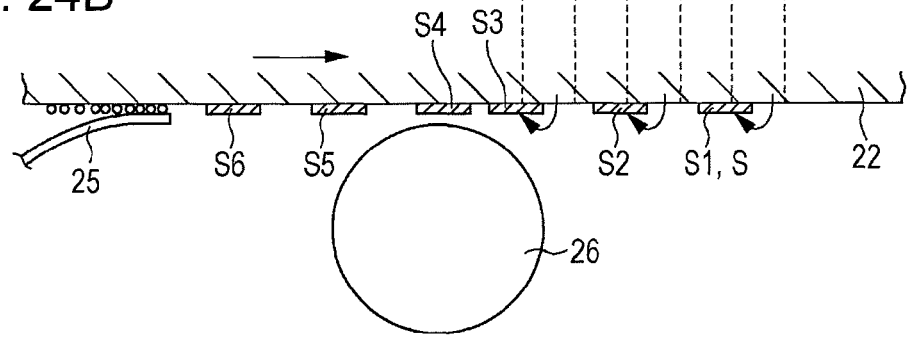
FIG. 24B schematically illustrates the process when two electrode members are used.

FIG. 24A illustrates a stripe pattern obtained when the sealing member 25 is provided but the following electrode member 26 is not provided. FIG. 24B illustrates a stripe pattern obtained when the sealing member 25 and the electrode member 26 are provided.

A projection formed by using a low-frequency electric field acting between the sealing member 25 and the developing roller 22 is moved to the upstream side by a further low-frequency electric field acting between the electrode member 26 and the developing roller 22. In FIG. 24B, the projections S1 to S3 have been moved to the upstream side.

In this manner, by making the same low-frequency electric field act at two positions, that is, the sealing member 25 and the electrode member 26, a stripe-shaped projection S formed by the sealing member 25 is further attracted by the electrode member 26, thereby reducing the adhesion of a projection S formed downstream of the electrode member 26 to the developing roller 22. Therefore, the residual toner on the developing roller 22 may be more easily scraped off.

While the low-frequency power source 34 (see FIG. 23) is connected to both the sealing member 25 and the electrode member 26 by way of example, different power sources may be connected to the sealing member 25 and the electrode member 26. The sizes of stripe-shaped projections formed downstream of the electrode member 26 may be appropriately selected.

Eighth Exemplary Embodiment

Figure 25:
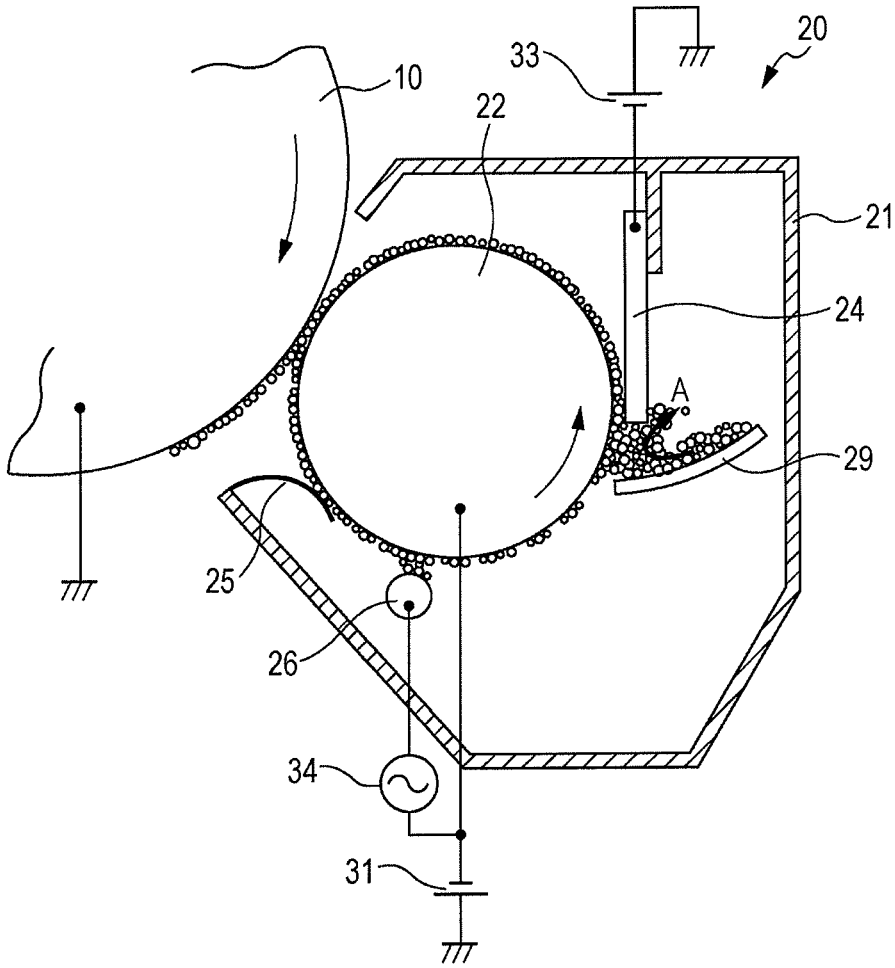
FIG. 25 illustrates an overview of a developing device according to an eighth exemplary embodiment.

FIG. 25 illustrates an overview of a developing device 20 according to an eighth exemplary embodiment.

The developing device 20 according to this exemplary embodiment is different from the developing devices 20 according to the other exemplary embodiments in that toner is supplied to the developing roller 22 using, instead of a supply roller, a supply member 29 disposed in close proximity to the developing roller 22. Elements similar to those in the first exemplary embodiment are represented by the same numerals, and a detailed description will be omitted.

In this exemplary embodiment, a layer forming unit that causes a developing roller 22 to hold toner and that regulates the layer thickness of the toner includes a supply member 29 that stores toner and supplies the toner to the developing roller 22, and the layer thickness regulating member 24.

The supply member 29 according to this exemplary embodiment is disposed so as to have a depression, and toner to be supplied is stored in the depression. The stored toner comes into contact with the rotating developing roller 22, and is therefore supplied. Toner that has dropped downward from the developing roller 22 in the container 21 is transported to the depression in the supply member 29 by using a mechanism (not illustrated).

In the above configuration, stripe-shaped projections on the developing roller 22 which have been formed by using a low-frequency electric field between the electrode member 26 and the developing roller 22 are scraped off between the supply member 29 and the developing roller 22 by supplying toner to the developing roller 22, or may be scraped off between the layer thickness regulating member 24 and the developing roller 22.

Therefore, even in the above configuration, the performance of scraping off the toner on the developing roller 22 may be ensured, and the occurrence of image defects such as ghosting may be suppressed or reduced.

According to the foregoing exemplary embodiments, the removal performance of the residual toner on the developing roller 22 after the developing operation may be improved. As a result, the occurrence of ghosting may be suppressed or reduced. In addition, a desired image with suppressed or reduced image defects such as background fogging may be uniformly maintained over a long period of time.

An existing method in which no stripe-shaped projections are formed provides low removal performance of the residual toner on the developing roller 22. Thus, undeveloped, remaining toner continuously remains on the developing roller 22. When the remaining toner successively passes through portions where the developing roller 22 and the supply roller 23 face, the developing roller 22 and the layer thickness regulating member 24 face, and the developing roller 22 and the photoconductor 10 face, the toner may suffer from stress, and an external additive may be separated from or embedded in the surface of the toner. Separating or embedding an external additive on the surface of the toner may change the charge properties of the surface of the toner, and may cause a reduction in charge amount. The fluidity of toner may also be reduced, and a toner thin layer formed on the developing roller 22 may become uneven. As a result, background fogging may occur in an image, and fringe may occur in the image. In the existing method, therefore, it is difficult to maintain high image quality with suppressed or reduced background fogging and the like over a long period of time. In contrast, as in this exemplary embodiment, stripe-shaped projections are formed, thus allowing the residual toner on the developing roller 22 to be removed, as desired. Therefore, the separating or embedding of an external additive of toner may be suppressed or reduced, and the advantage of maintaining desired image quality over a long period of time may also be achieved.

EXAMPLE

In this example, the relationship between the peripheral speed of a developing roller and a frequency of a low-frequency electric field is observed in an experiment under the following conditions:

Outer diameter of developing roller: ϕ18 mm

Outer diameter of supply roller: ϕ18 mm

Contact width of nip portion between developing roller and supply roller: 4.25 mm, where the intrusion of the supply roller is set to 0.5 mm Electrode member: stainless bar of ϕ5 mm Gap between electrode member and developing roller: 300 μm Peripheral speed of developing roller: 300 mm/second Vpp of low-frequency electric field (rectangular wave): 1.2 kV (which may be appropriately set from the relationship with the gap as long as toner flies from the developing roller and no leak discharge is generated. For example, 0.8 kV to 2 kV)

Evaluation is made by visual observation of a pattern on the developing roller located after the sealing member and by visual observation of ghosting when a 30% halftone image is formed after solid printing. The evaluation of ghosting indicates: circle (good), triangle (ghosting is visually observed but negligible in practical use), and cross (ghosting is noticeable).

The result is as illustrated in FIG. 26. A stripe pattern including projections having a small width is slightly unclear. Good results are obtained for a projection having a width of 0.8 to 3 mm in terms of the occurrence of ghosting. The visual observation results are not good for a projection having a width of 1.2 mm or less. Therefore, more preferable frequencies are 100 to 50 Hz with respect to a projection having a width of 1.5 to 3 mm. The present inventors perform the experiment under an additional condition of a frequency of 37.5 Hz with respect to a projection having a width of 4 mm, and find that there is no problem with ghosting.

From the above results, it is found that the formation of stripe-shaped projections is effective.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a container that accommodates toner serving as developer, the container having an opening facing a latent image holding member that holds a latent image;

a toner holding member that is rotatably disposed in the container in such a manner that the toner holding member faces the latent image holding member in a portion thereof facing the opening, the toner holding member being configured to hold toner and transport the toner to a developing region where the toner holding member and the latent image holding member face;

a developing electric field forming unit that forms a developing electric field for developing the latent image on the latent image holding member using the toner on the toner holding member in the developing region where the toner holding member and the latent image holding member face;

a layer forming unit that is provided for the toner holding member and that forms a toner layer having a predetermined layer thickness on the toner holding member prior to the developing region;

an electrode member that is disposed so as to face the toner holding member at a position which is downstream of the developing region and upstream of the layer forming unit in a rotation direction of the toner holding member and that is disposed so as to extend in a direction intersecting the rotation direction of the toner holding member, the electrode member including at least a portion formed of a conductive member and being used to make an electric field act between the conductive member and the toner holding member; and a low-frequency electric field forming unit that forms a low-frequency electric field whose polarity alternately changes periodically at a predetermined low frequency, the low-frequency electric field being made to act on residual toner between the electrode member and the toner holding member, the low-frequency electric field forming unit causing the residual toner on the toner holding member to move to form stripe-shaped projections having a visually observable size in the rotation direction of the toner holding member in accordance with a period of the low-frequency electric field.

2. The developing device according to claim 1, wherein when forming the low-frequency electric field, the low-frequency electric field forming unit satisfies a relationship of $f \leq v/d$, where v denotes a peripheral speed of the toner holding member, f denotes a frequency of the low-frequency electric field, and d denotes a minimum dimension of a period of the stripe-shaped projections.

3. The developing device according to claim 1, wherein the electrode member is a roller-shaped member disposed so as to face the toner holding member with a gap therebetween exceeding a thickness of the toner layer on the toner holding member formed by the layer forming unit.

4. The developing device according to claim 1, wherein a relationship of $m \geq n$ is satisfied, where m denotes a width of an acting area on the electrode member where the low-frequency electric field acts in the rotation direction of the toner holding member, and n denotes a moving distance of the toner holding member in the rotation direction of the toner holding member, the moving distance corresponding to a time during which an electric field component that attracts the residual toner on the toner holding member toward the toner holding member within the low-frequency electric field acts.

5. The developing device according to claim 1, wherein when forming the low-frequency electric field, the low-frequency electric field forming unit satisfies a relationship of $E1 \geq E2$, where E1 denotes an electric field component that attracts toner toward the electrode member from the toner holding member, and E2 denotes an electric field component that attracts toner toward the toner holding member from the electrode member.

6. The developing device according to claim 1, wherein when forming the low-frequency electric field, the low-frequency electric field forming unit satisfies a relationship of $t1 \geq t2$, where t1 denotes an acting time of an electric field component that attracts toner toward the electrode member from the toner holding member within a period of the low-frequency electric field, and t2 denotes an acting time of an electric field component that attracts toner toward the toner holding member from the electrode member within the period of the low-frequency electric field.

7. The developing device according to claim 1, wherein the developing electric field forming unit forms a developing electric field including a first high-frequency electric field whose polarity alternately changes periodically at a predetermined high frequency, and the low-frequency electric field forming unit makes a second high-frequency electric field act on the electrode member, the second high-frequency electric field having a frequency close to a frequency of the first high-frequency electric field, and forms as the low-frequency electric field a low-frequency beat component produced by a difference between the first high-frequency electric field and the second high-frequency electric field.

8. The developing device according to claim 1, wherein the electrode member has an electric field acting region in which an electric field acts, and the electric field acting region is longer than an effective width in a longitudinal direction of the developing region.

9. The developing device according to claim 1, further comprising:

a gap changing mechanism that movably supports the electrode member and that changes a gap between the electrode member and the toner holding member.

10. The developing device according to claim 1, wherein the layer forming unit includes a toner supply member that supplies toner to the toner holding member in contact with the toner holding member, the toner supply member is rotated in a direction opposite to the rotation direction of the toner holding member in a portion where the toner supply member is in contact with the toner holding member, and a relationship of w>n is satisfied, where w denotes a contact width that is a width of the toner holding member in contact with the toner supply member in the rotation direction of the toner holding member, and n denotes a moving distance of the toner holding member in the rotation direction of the toner holding member, the moving distance corresponding to a time during which an electric field component that attracts the residual toner on the toner holding member toward the toner holding member within the low-frequency electric field acts.

11. An image forming apparatus comprising:

a latent image holding member that holds a latent image; and the developing device according to claim 1, the developing device being configured to develop the latent image on the latent image holding member using toner.

* * * * *